US011855334B2

(12) United States Patent
Hsu et al.

(10) Patent No.: US 11,855,334 B2
(45) Date of Patent: Dec. 26, 2023

(54) ANTENNA MODULE AND ELECTRONIC DEVICE USING THE SAME

(71) Applicant: Chiun Mai Communication Systems, Inc., New Taipei (TW)

(72) Inventors: Cho-Kang Hsu, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 367 days.

(21) Appl. No.: 17/378,920

(22) Filed: Jul. 19, 2021

(65) Prior Publication Data

US 2022/0021105 A1 Jan. 20, 2022

Related U.S. Application Data

(60) Provisional application No. 63/052,611, filed on Jul. 16, 2020.

(51) Int. Cl.

| | |
|---|---|
| ***H01Q 5/335*** | (2015.01) |
| ***H01Q 21/30*** | (2006.01) |
| ***H01Q 1/24*** | (2006.01) |
| ***H01Q 23/00*** | (2006.01) |
| ***H01Q 9/04*** | (2006.01) |
| ***H01Q 13/08*** | (2006.01) |
| ***H01Q 5/371*** | (2015.01) |
| ***H01Q 3/24*** | (2006.01) |
| ***H01Q 25/04*** | (2006.01) |

(52) U.S. Cl.

CPC ..... *H01Q 1/243* (2013.01); *H01Q 3/24* (2013.01); *H01Q 5/371* (2015.01); *H01Q 9/0407* (2013.01); *H01Q 13/085* (2013.01); *H01Q 23/00* (2013.01); *H01Q 25/04* (2013.01)

(58) Field of Classification Search

CPC ..... H01Q 1/243; H01Q 3/24; H01Q 5/353; H01Q 5/371; H01Q 5/378; H01Q 9/0407; H01Q 9/0421; H01Q 9/42; H01Q 13/085

See application file for complete search history.

(56) References Cited

U.S. PATENT DOCUMENTS 8,587,486 B2 * 11/2013 Chiu ..... H01Q 9/0421 343/702
9,406,998 B2 * 8/2016 Korva ..... H01Q 21/30
(Continued)

FOREIGN PATENT DOCUMENTS

CN 110854507 A 2/2020

*Primary Examiner* — Tuan Pham
(74) *Attorney, Agent, or Firm* — ScienBiziP, P.C.

(57) ABSTRACT

An antenna module includes a substrate, a radiation portion, and an active circuit. The radiation portion and the active circuit are both arranged on the substrate. The radiation portion is a complete sheet body made of conductive material, at least one signal feed point is arranged on one side of the radiation portion to feed electrical signals to the radiation portion. The radiation portion defines at least one slot, the slot divides the radiation portion into radiation branches arranged at intervals. Each radiation branch is electrically connected to a signal feeding point, so as to feed electric signals to the radiation branch. The active circuit is electrically connected to the radiation portion to switch radiation modes of the radiation portion. The application also provides an electronic device with the antenna module.

16 Claims, 22 Drawing Sheets

(56) References Cited

U.S. PATENT DOCUMENTS

| | | | | |
|---|---|---|---|---|
| 2003/0201943 | A1* | 10/2003 | Kadambi ..... | H01Q 5/378<br>343/702 |
| 2008/0055164 | A1 | 3/2008 | Zhang | |
| 2009/0278757 | A1 | 11/2009 | Ahn et al. | |

* cited by examiner

ANTENNA MODULE AND ELECTRONIC DEVICE USING THE SAME

TECHNICAL FIELD

The present disclosure relates to the field of communication technology, in particular to antenna module and electronic device.

BACKGROUND

With the advancement of wireless communication technology, electronic devices such as mobile phones continue to develop toward the trend of diversified functions, thinner and lighter, and faster and more efficient data transmission. The space that can receive antennas is getting smaller and smaller, and with the continuous development of wireless communication technology, the demand for antenna bandwidth continues to increase. How to design an antenna with a wider bandwidth and better efficiency in a limited space is an important issue facing antenna design.

Therefore, there is a room for improvement.

DETAILED DESCRIPTION

Figure 1:
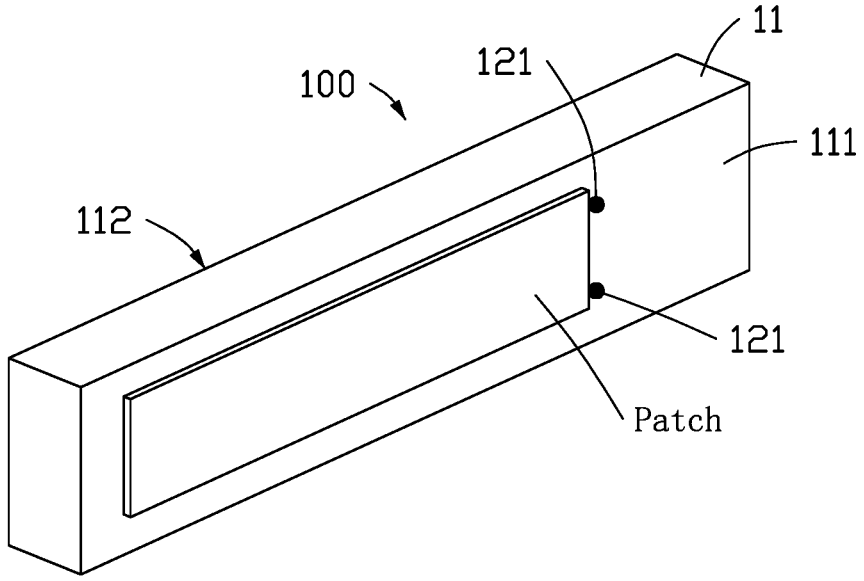
FIG. 1 is a schematic diagram of an antenna module of an embodiment of the present disclosure.

In order to make the purpose, technical solutions and advantages of the embodiments of the present disclosure clearer, the technical solutions in the embodiments of the present disclosure will be described clearly and completely in conjunction with the drawings in the embodiments of the present disclosure. Based on the embodiments of the present disclosure, all other embodiments obtained by those of ordinary skill in the art without creative work shall fall within the scope of protection of the present disclosure.

Those skilled in the art should understand that, in the disclosure of the present disclosure, "at least one" refers to one or more, and multiple refers to two or more. Unless otherwise defined, all technical and scientific terms used herein have the same meaning as commonly understood by those skilled in the technical field in the present disclosure. The terminology used in the specification of present disclosure is only for the purpose of describing specific embodiments, and is not intended to limit the present disclosure.

It can be understood that, unless otherwise specified in the present disclosure, "/" means "or". For example, AB can mean A or B. "A and/or B" in the present disclosure is only an association relationship describing the associated objects, which means that there can be three relationships: only A, only B, and A and B.

It can be understood that, in the disclosure of the present disclosure, the words such as "first" and "second" are only used for the purpose of distinguishing description, and cannot be understood as indicating or implying relative importance, nor as indicating or implying order. The features defined with "first" and "second" may explicitly or implicitly include one or more of the features. In the description of the embodiments of the present disclosure, the words such as "exemplary" or "for example" are used as examples, illustrations, or illustrations. Any embodiment or design solution described as "exemplary" or "for example" in the embodiments of the present disclosure should not be construed as being more preferable or advantageous than other embodiments or design solutions. To be precise, the words such as "exemplary" or "for example" are used to present related concepts in a specific manner.

Those skilled in the art should understand that, in the disclosure of the present disclosure, the terms "longitudinal", "lateral", "upper", "lower", "front", "rear", "left", "right", the orientation or positional relationship indicated by "vertical", "horizontal", "top", "bottom", "inner", "outer", etc. are based on the orientation or positional relationship shown in the drawings, which is only for the convenience of describing the present disclosure and to simplify the description, rather than indicating or implying that the device or element referred to must have a specific orientation, or be constructed and operated in a specific orientation, so the above terms should not be understood as limiting the present disclosure.

Figure 2:
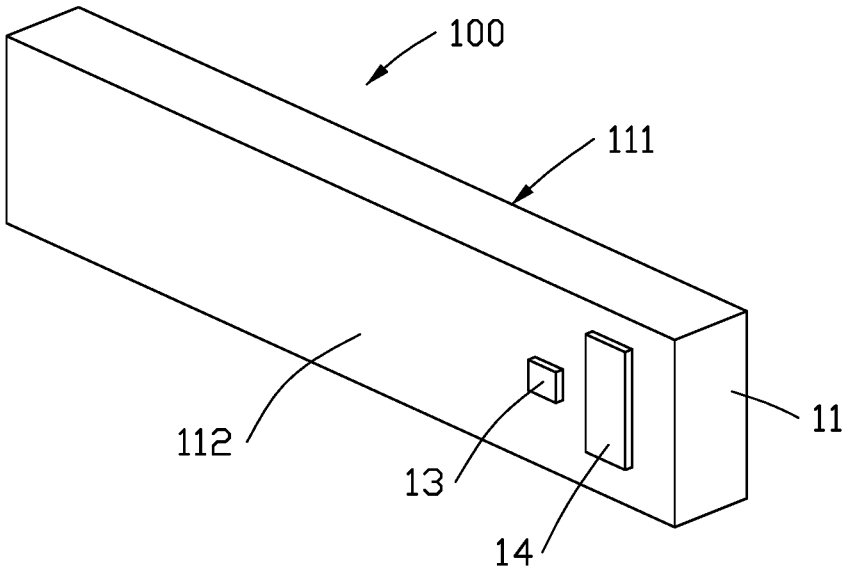
FIG. 2 is a schematic diagram of the antenna module shown in FIG. 1 from another angle.

FIGS. 1 and 2 illustrate an antenna module 100 in accordance with an embodiment of the present disclosure. The antenna module 100 includes a substrate 11, a radiation portion Patch, an active circuit 13 (shown in FIG. 2), and a connector 14 (shown in FIG. 2).

The substrate 11 may be a dielectric substrate, for example, a printed circuit board (PCB), a ceramic (ceramics) substrate or other dielectric substrate, which is not specifically limited herein. The base substrate 11 includes a first surface 111 and a second surface 112, and the second surface 112 is disposed opposite to the first surface 111.

In the embodiment of the present disclosure, the radiation portion Patch is in the shape of a metal flake as a whole. The radiation portion Patch is disposed on the first surface 111 of the substrate 11. The radiation portion Patch may be connected to the second surface 112 of the substrate 11 through a through hole (via).

Figure 3A:
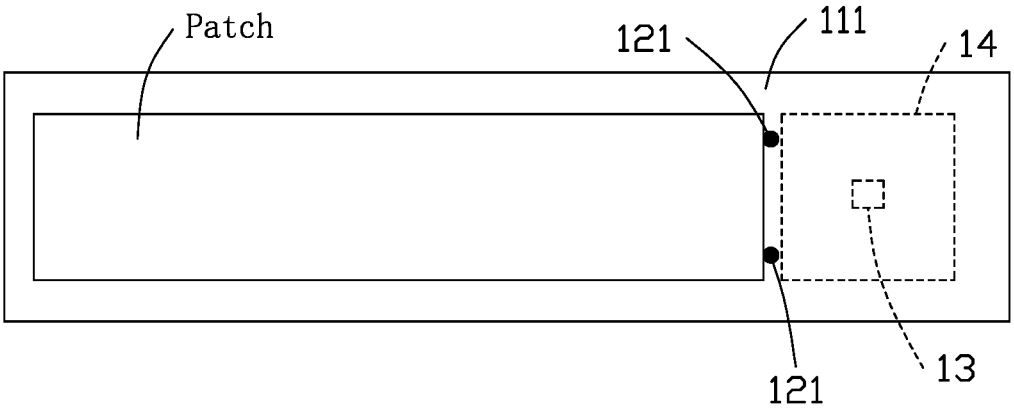
FIGS. 3A to 3J are schematic diagrams of a radiation portion in the antenna module according to the embodiment of the present disclosure.

Please also refer to FIG. 3A, in one of the embodiments, the radiation portion Patch is generally rectangular, and its surface is not provided with any gaps, slots, breakpoints, etc. Two or more (for example, two as shown in the figure) signal feed points 121 are provided on one side of the radiation portion Patch. The signal feed point 121 is used to electrically connect to a corresponding feeding source (not shown in the figure, see detailed later) through a matching circuit (not shown in the figure, see detailed later), and then feed electrical signals to the radiation portion Patch. In addition, the antenna module 100 covers different frequency bands by switching the radiation portion Patch to different signal feed point 121.

The embodiment of the present disclosure does not limit the specific shape and structure of the radiation portion Patch. For example, please also refer to FIG. 3B, in another embodiment of the present disclosure, the radiation portion Patch is generally rectangular. The radiation portion Patch defines a slot 122, and the slot 122 is used to divide the radiation portion Patch into a plurality of radiation branches. For example, in the embodiment shown in FIG. 3B, the slot 122 is substantially L-shaped. After extending a distance from one long side of the radiation portion Patch to another long side, the slot 122 is bent at a right angle to extend in a direction parallel to the long side, and close to the short side of the connector 14, until it extends and separates the short side. Thus, the slot 122 separates one of the long sides and the short sides of the radiation portion Patch, thereby forming an L shape as a whole, and dividing the radiation portion Patch into a first radiation branch Patch1 and a second radiation branch Patch2 that are arranged at intervals. In the embodiment of the present disclosure, one radiation branch (for example, the first radiation branch Patch1) is L-shaped, and the other radiation branch (for example, the second radiation branch Patch2) is rectangular. The two radiation branches are respectively provided with corresponding signal feed point 121, and then the corresponding radiation branches are fed with electrical signals respectively.

Figure 3B:
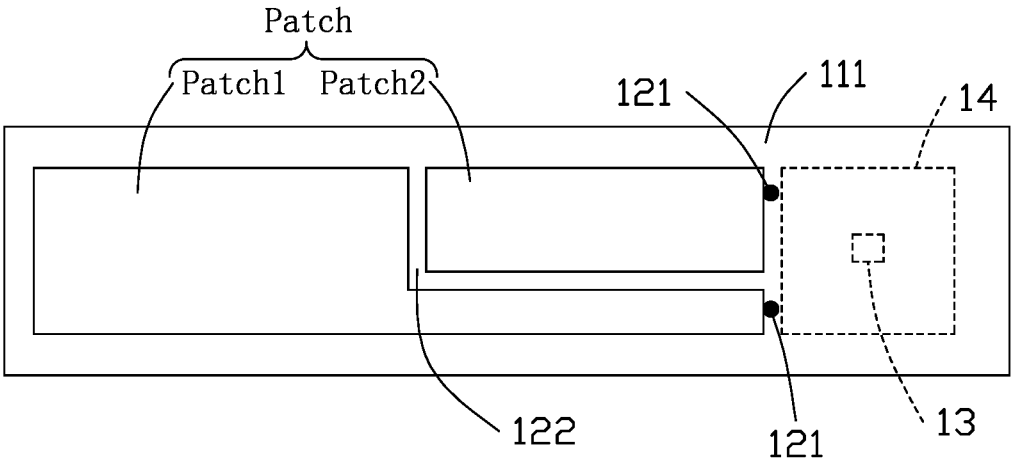
Figure 3C:
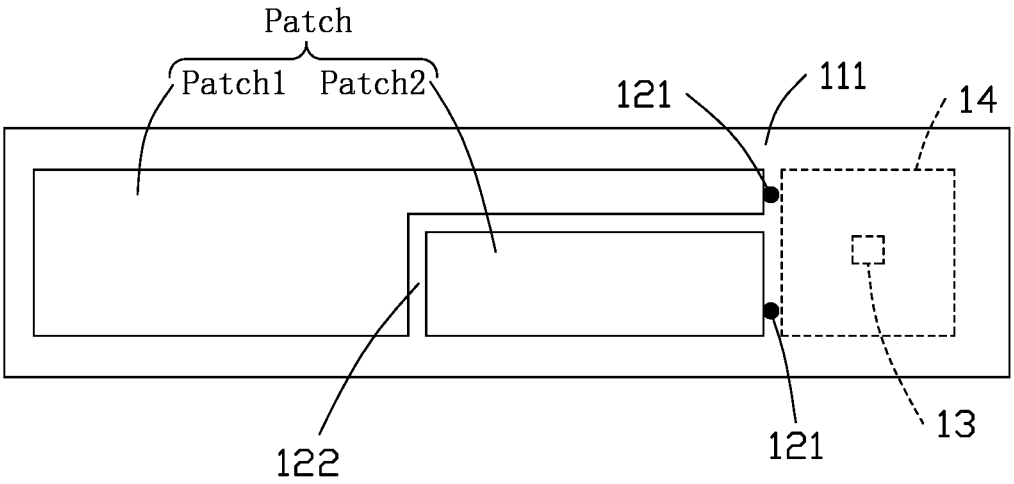

Please also refer to FIG. 3C, in another embodiment of the present disclosure, the radiation portion Patch has a rectangular shape as a whole. The radiation portion Patch defines a slot 122, and the slot 122 is used to divide the radiation portion Patch into a plurality of radiation branches. For example, in the embodiment shown in FIG. 3C, the slot 122 is substantially L-shaped. After extending a distance from one long side of the radiation portion Patch to the other long side, the slot 122 is bent at a right angle to extend in a direction parallel to the long side and close to the short side of the connector 14, until it extends to the short side. Therefore, the slot 122 separates one of the long sides and the short sides of the radiation portion Patch, thereby forming an L shape as a whole, and dividing the radiation portion Patch into a first radiation branch Patch1 and a second radiation branch Patch2 that are arranged at intervals. In the embodiment of this present disclosure, one of the radiation branches (for example, the first radiation branch Patch1) is L-shaped, and the other radiation branch (for example, the second radiation branch Patch2) is rectangular. The two radiation branches are respectively provided with corresponding signal feed point 121, and then the corresponding radiation branches are fed with electrical signals respectively. In the embodiment shown in FIG. 3C, it is different from the embodiment shown in FIG. 3B in that the arrangement of the slot 122 is different, as a result, the shapes of the first radiation branch Patch1 and the second radiation branch Patch2 are slightly different from those of the first radiation branch Patch1 and the second radiation branch Patch2 in FIG. 3B.

Figure 3D:
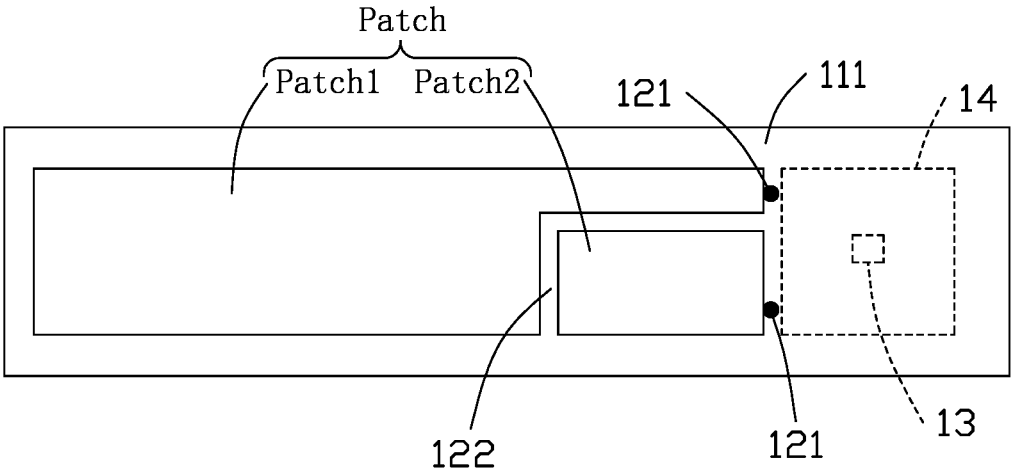

Please also refer to FIG. 3D, in another embodiment of the present disclosure, the radiation portion Patch has a rectangular shape as a whole. The radiation portion Patch defines a slot 122, and the slot 122 is used to divide the radiation portion Patch into a plurality of radiation branches. In the embodiment shown in FIG. 3D, the arrangement of the slot 122 is substantially the same as the arrangement of the slot 122 shown in FIG. 3C, the difference is that the size and ratio of the first radiation branch Patch1 and the second radiation branch Patch2 are slightly different. For example, the area of the first radiation branch Patch1 shown in FIG. 3D is larger than that of the first radiation branch Patch1 shown in FIG. 3C. Correspondingly, the area of the second radiation branch Patch2 shown in FIG. 3D is smaller than that of the second radiation branch Patch2 shown in FIG. 3C. In the embodiment shown in FIG. 3D, the ratio of the first radiation branch Patch1 and the first radiation branch Patch1 is different from the ratio of the first radiation branch Patch1 and the second radiation branch Patch2 shown in FIG. 3C, and is slightly larger than the ratio of the first radiation branch Patch1 to the second radiation branch Patch2 shown in FIG. 3C.

Figure 3E:
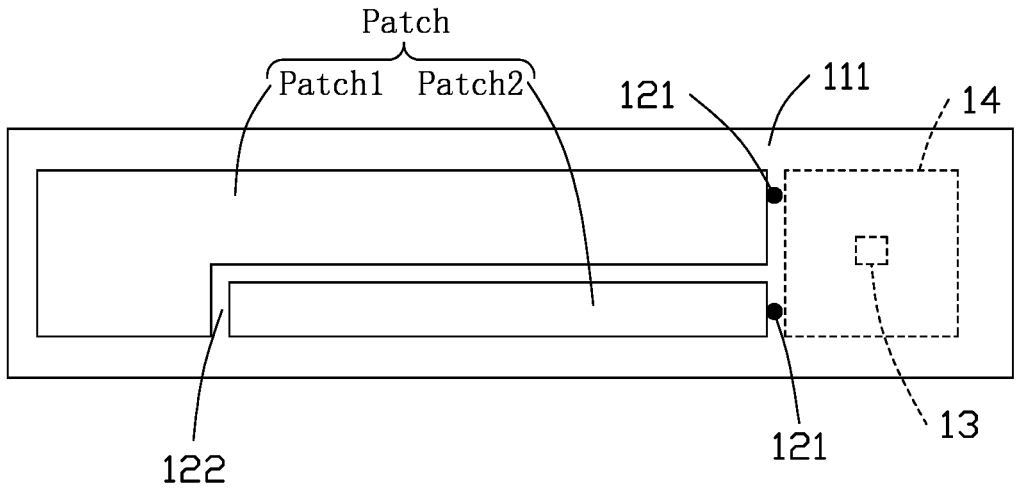

Please also refer to FIG. 3E, in another embodiment of the present disclosure, the radiation portion Patch has a rectangular shape as a whole. The radiation portion Patch defines a slot 122, and the slot 122 is used to divide the radiation portion Patch into a plurality of radiation branches. In the embodiment shown in FIG. 3E, the arrangement of the slot 122 is substantially the same as the arrangement of the slot 122 shown in FIG. 3C, the difference is that the size and ratio of the first radiation branch Patch1 and the second radiation branch Patch2 are slightly different. For example, the area of the first radiation branch Patch1 shown in FIG. 3E is larger than that of the first radiation branch Patch1 shown in FIG. 3C. Correspondingly, the area of the second radiation branch Patch2 shown in FIG. 3E is smaller than that of the second radiation branch Patch2 shown in FIG. 3C. In the embodiment shown in FIG. 3E, the ratio of the first radiation branch Patch1 and the second radiation branch Patch2 is different from the ratio of the first radiation branch Patch1 and the second radiation branch Patch2 shown in FIG. 3C.

Figure 3F:
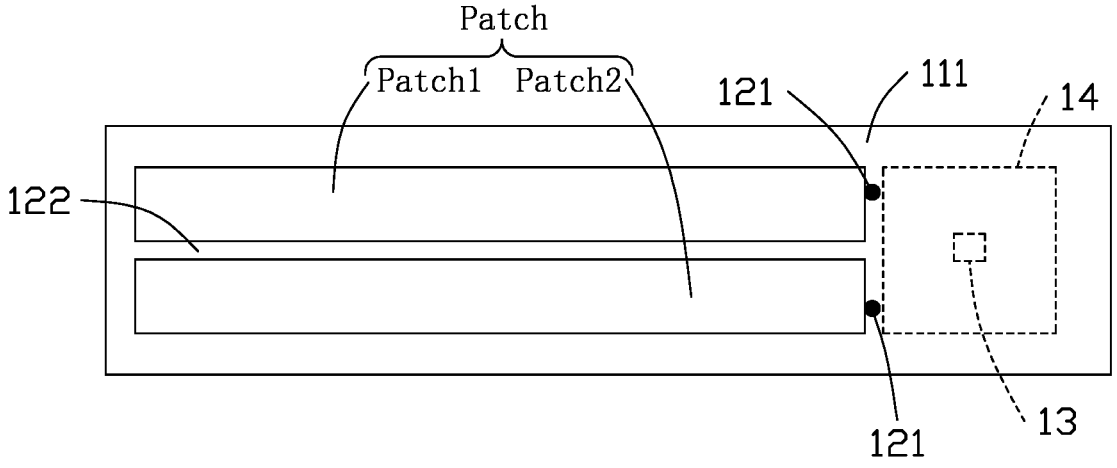

Please also refer to FIG. 3F, in another embodiment of the present disclosure, the radiation portion Patch has a rectangular shape as a whole. The radiation portion Patch defines a slot 122, and the slot 122 is used to divide the radiation portion Patch into a plurality of radiation branches. In the embodiment shown in FIG. 3F, the slot 122 is strip-shaped as a whole (that is, in a straight shape), and it extends from one of the short sides of the radiation portion Patch in a direction parallel to the long side thereof, until it extends to the other relatively short side of the radiation portion Patch further, to divide the radiation portion Patch into a first radiation branch Patch1 and a second radiation branch Patch2 arranged at intervals. The first radiation branch Patch1 and the second radiation branch Patch2 are both rectangular, and both are arranged parallel to the long side of the radiation portion Patch. In the embodiment of the present disclosure, each radiation branch is provided with a corresponding signal feed point 121, and then the corresponding radiation branch is fed with electrical signals.

As shown in FIG. 3B to FIG. 3F, the radiation portion Patch is divided into two radiation branches by setting a slot 122. The area allocation of the two radiation branches can be adjusted proportionally according to the bandwidth requirements, so that a wider frequency coupling effect can be provided through a large area. For example, when the radiation branch of the radiation portion Patch is close to the radiation body (such as a metal frame), the two are not in contact, the signal can be transmitted to the radiation body through coupling, and the radiation body can transmit/receive the signal. When the area distribution of the radiation branch is larger, the signal will be transmitted/received from the radiation body through coupling, and the resulting bandwidth will be wider, thereby realizing a larger area to provide a wider frequency coupling effect.

Figure 3G:
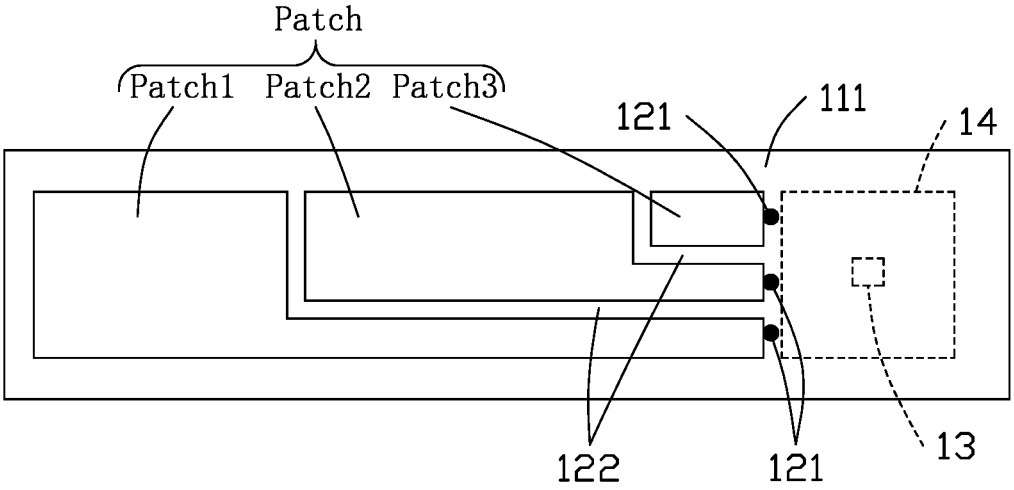

In other embodiments, the number of the slot 122 is not limited, the radiation portion Patch is not limited to one slot 122. For example, please also refer to FIG. 3G in another embodiment of the present disclosure, the radiation portion Patch is approximately rectangular, and the radiation portion Patch is provided with a plurality of (for example, two slots 122) slots 122. The shape of the slot 122 is generally L-shaped, and its opening method is similar to the opening method of the slot 122 in the embodiment shown in FIG. 3B, and the radiation portion Patch is further divided into multiple (for example, three) radiation branches (for example, the first radiation branch Patch1, the second radiation branch Patch2, and the third radiation branch Patch3). The first radiation branch Patch1, the second radiation branch Patch2, and the third radiation branch Patch3 are spaced apart from each other. The first radiation branch Patch1 and the second radiation branch Patch2 are both L-shaped. The third radiation branch Patch3 has a rectangular shape. The first radiation branch Patch1, the second radiation branch Patch2 and the third radiation branch Patch3 are arranged in the lower left corner, the middle, and the upper right corner of the radiation portion Patch in order, and their sizes decrease in order. In the embodiment of the present disclosure, each radiation branch is provided with a corresponding signal feed point 121, and the corresponding radiation branch is fed with electrical signals.

Figure 3H:
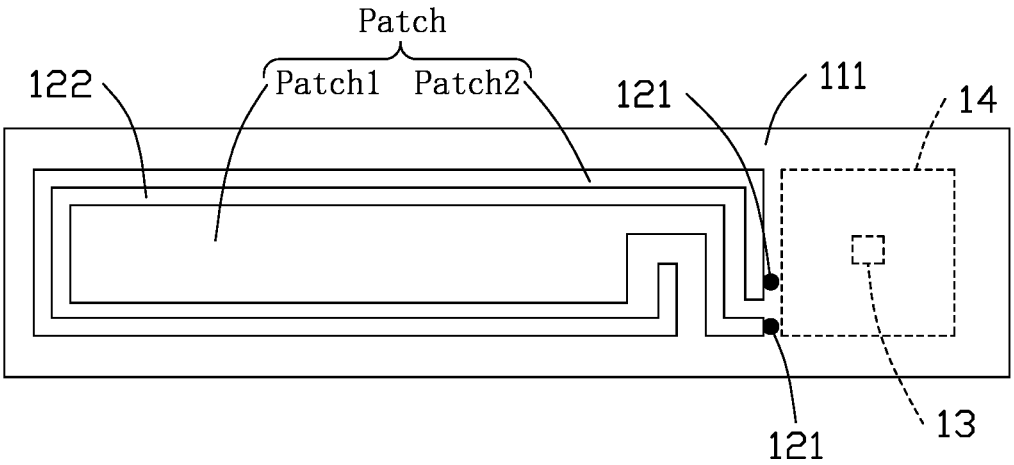

Please also refer to FIG. 3H, in another embodiment of the present disclosure, the radiation portion Patch is roughly rectangular, and the radiation portion Patch defines a slot 122. The slot 122 is an irregular shape, which extends from a long side of the radiation portion Patch (for example, the long side of the bottom side) and bends for many times, and finally extends to a short side that separates the radiation portion Patch (for example, close to the short side of the connector 14), and the radiation portion Patch is divided into a plurality of (for example, two) radiation branches (for example, the first radiation branch Patch1 and the second radiation branch Patch2). The first radiation branch Patch1 and the second radiation branch Patch2 are spaced apart from each other. The first radiation branch Patch1 is roughly S-shaped. The second radiation branch Patch2 is substantially in the shape of a non-closed mouth, and is arranged on the periphery of the first radiation branch Patch1. In the embodiment of the present disclosure, each radiation branch is provided with a corresponding signal feed point 121, and the corresponding radiation branch is fed with electrical signals.

Figure 3I:
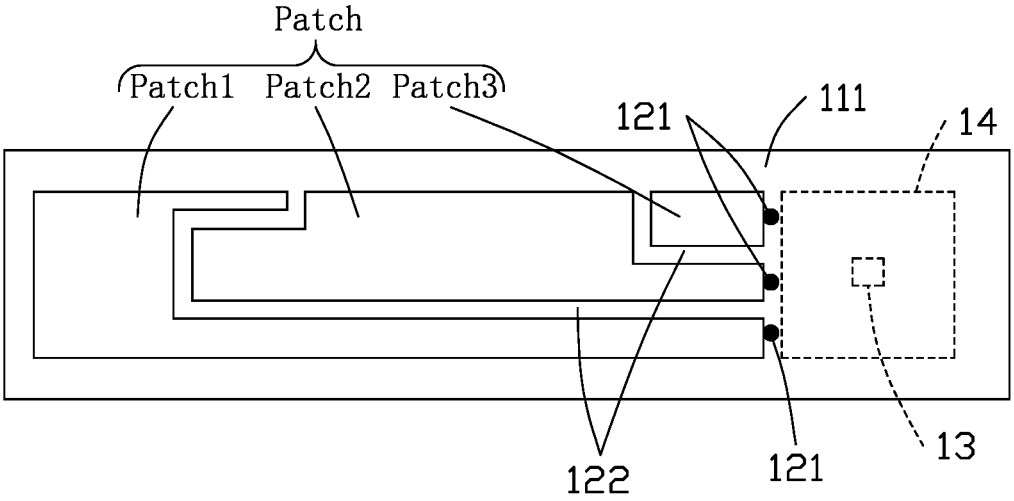

Please also refer to FIG. 3I, in another embodiment, the radiation portion Patch is substantially rectangular, the radiation portion Patch defines a plurality of slots 122, for example, two slots 122, one of the slot 122 is L-shaped, and the other slot 122 is zigzag-shaped. One ends of the two slot 122 are both set on a long side (for example, the long side of the bottom side) of the radiation portion Patch, and are spaced apart from each other, then start to extend separately, and then all extend to a short side of the radiation portion Patch (for example, the short side close to the connector 14), and the short side is also spaced apart, and the radiation portion Patch is divided into a plurality of (for example, three) radiation branches (for example, the first radiation branch Patch1, the second radiation branch Patch2 and the third radiation branch Patch3). The first radiation branch Patch1, the second radiation branch Patch2 and the third radiation branch Patch3 are spaced apart from each other. The first radiation branch Patch1 is roughly C-shaped and is arranged on one side of the radiation portion Patch. The second radiation branch Patch2 is substantially in the shape of an inverted T, which is arranged between the first radiation branch Patch1 and the third radiation branch Patch3, and the third radiation branch Patch3 is rectangular. In the embodiment shown in FIG. 3I, the area of the third radiation branch Patch3 is the smallest, and each radiation branch is provided with a corresponding signal feed point 121, which in turn feeds electrical signals to the corresponding radiation branches.

Figure 3J:
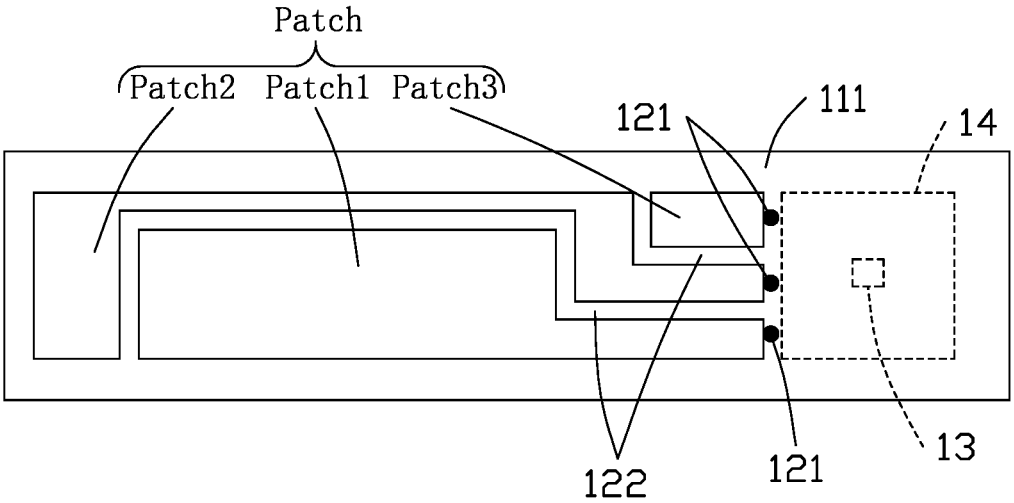

Please also refer to FIG. 3J, in another embodiment, the radiation portion Patch is roughly rectangular, the radiation portion Patch defines a plurality of slots 122, for example, two slots 122. One of the slot 122 is L-shaped, and the other slot 122 is zigzag-shaped. One ends of the two slot 122 are respectively arranged on the two long sides of the radiation portion Patch, and are spaced apart from each other, then start to extend separately, and then all extend to a short side that separates the radiation portion Patch (for example, the short side close to the connector 14), and the short side is also spaced apart, to divide the radiation portion Patch into the plurality of radiation branches, for example, three radiation branches (such as the first radiation branch Patch1, the second radiation branch Patch2 and the third radiation branch Patch3). The first radiation branch Patch1, the second radiation branch Patch2 and the third radiation branch Patch3 are spaced apart from each other. The first radiation branch Patch1 is approximately L-shaped, and is disposed at the bottom of the radiation portion Patch. The second radiation branch Patch2 is approximately π-shaped, and is arranged between the first radiation branch Patch1 and the third radiation branch Patch3. The third radiation branch Patch3 has a rectangular shape. In the embodiment shown in FIG. 3J, the area of the third radiation branch Patch3 is the smallest, and each radiation branch is provided with a corresponding signal feed point 121, which in turn feeds electrical signals to the corresponding radiation branches.

As shown in FIGS. 3A to 3J, for a single radiation portion Patch, the radiation branches divided by the radiation portion Patch can be rectangular, L-shaped, non-closed mouth-shaped, S-shaped, C-shaped, T-shaped, π-shaped or a combination thereof, to work together to excite the corresponding frequency band.

In other embodiments, the shape and structure of the radiation portion Patch are not limited to those described above, and may also be other shapes and structures, which are not specifically limited herein.

In the embodiment of the present disclosure, as shown in FIGS. 3B to 3F, the two ends of the slot 122 can be arranged on two adjacent sides of the radiation portion Patch (for example, the long side and the short side described above) or on the two opposite sides, and by changing the shape and arrangement position of the slot 122, the radiation branches of different shapes can be cut out.

Please refer to FIG. 2, in the embodiment of the present disclosure, the active circuit 13 is disposed on the second surface 112 of the substrate 11. The second surface 112 of the substrate 11 is provided with connection lines (not shown). The connection line is connected to the active circuit 13. The active circuit 13 may include a switch, and/or other adjustable elements that can change impedance (not shown in the figure, see details below). The active circuit 13 can be electrically connected to the radiation portion Patch and the connector 14 through the connection line. For example, in one of the embodiments, the substrate 11 is further provided with a via hole (not shown), and the radiation portion Patch can be connected to the second surface 112 of the substrate 11 through the via hole, and connected to the active circuit 13 through the connection line on the second surface 112.

The connector 14 is arranged on the second surface 112 of the substrate 11, the connector 14 is arranged on the surface where the active circuit 13 is located. In some embodiments, the connector 14 and the active circuit 13 may be spaced apart and electrically connected to each other. In the embodiment of the present disclosure, the specific positional relationship and connection relationship between the connector 14 and the active circuit 13 are not limited. For example, in one of the embodiments, the active circuit 13 can be disposed in the connector 14, the connector 14 can be used to accommodate the active circuit 13. The connector 14 is electrically connected to the active circuit 13 and connected to a corresponding transmission line, and then realizes the signal transmission of the antenna module 100 through the transmission line, for example, realizes signal sending or sending.

It can be understood that the transmission line can be, but is not limited to, a coaxial cable (coaxial cable), a flexible printed circuit board (flexible printed circuit board, FPCB) or other transmission lines.

Figure 4:
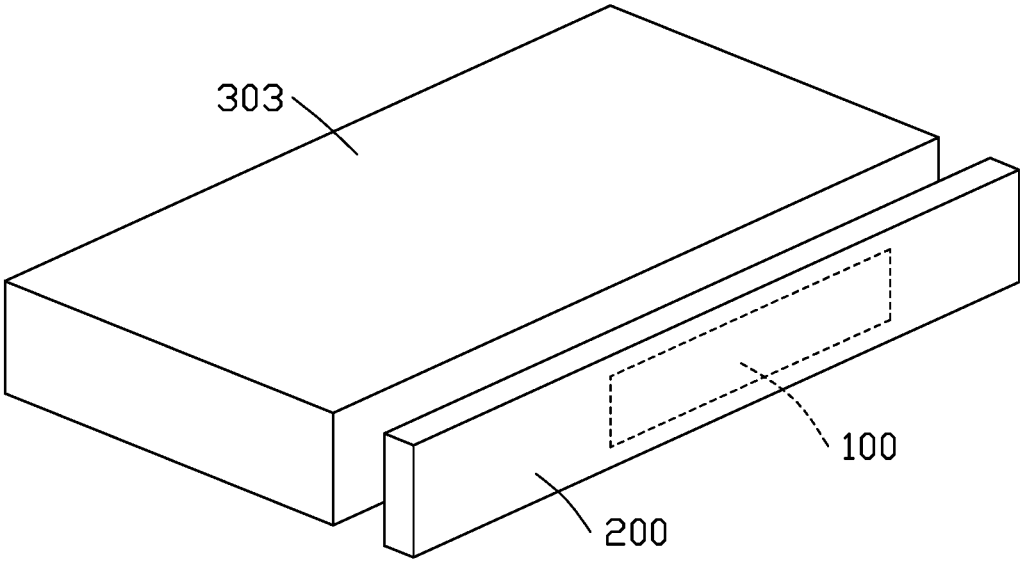
FIG. 4 is a schematic diagram of the antenna module arranged on one side of a radiation body according to an embodiment of the present disclosure.
Figure 5:
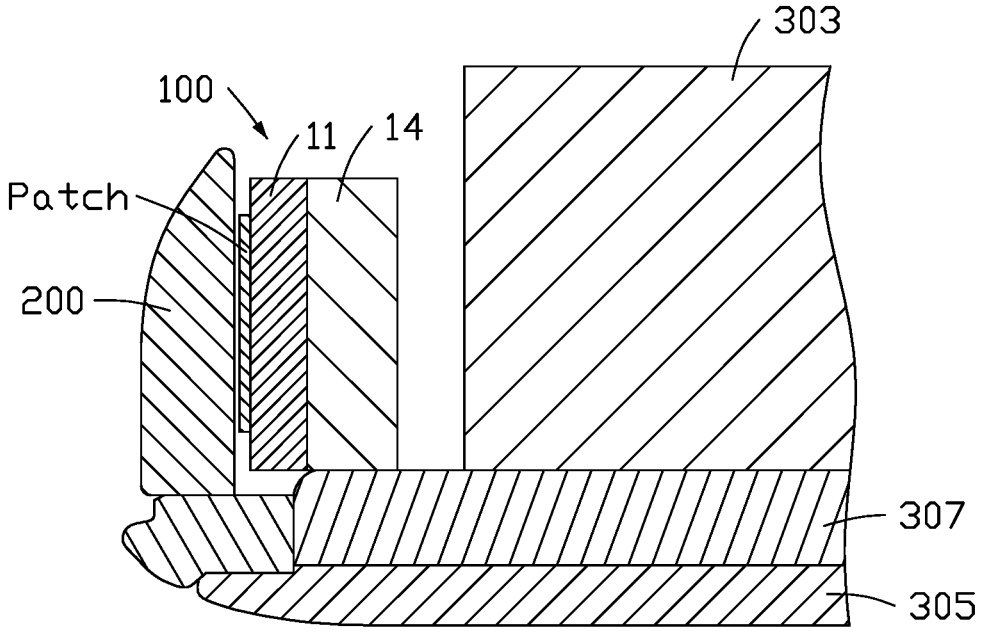
FIG. 5 is a schematic diagram of the antenna module and the radiation body shown in FIG. 4 at another angle.

Please refer to FIG. 4 and FIG. 5 together, when the antenna module 100 is used, the antenna module 100 can be arranged on one side of a radiation body 200. The antenna module 100 is provided with a radiation portion Patch on one side facing the radiation body 200. Therefore, signals can be transmitted and/or received by the radiation body 200 through the coupling of the radiation portion Patch and the radiation body 200. In addition, the antenna module 100 can also use the switch of the active circuit 13 to switch multi-modes, thereby realizing multiple broadband operations.

For example, in one of the embodiments, when the radiation portion Patch of the antenna module 100 includes three radiation branches, and the active circuit 13 is provided, the three radiation branches are arranged at intervals, and are arranged at intervals from the radiation body 200, to receive 4G/5G intermediate frequency signals (frequency range of 1.7 GHz-2.2 GHz), high frequency signals (frequency range of 2.3 GHz-2.7 GHz), ultra high band (UHB) signals (frequency range of 3.3 GHz-5 GHz), GPS signal (frequency range of 1.5 GHz-1.6 GHz), Wi-Fi signal (frequency range of 2.4 GHz, 5 GHz).

In the embodiment of the present disclosure, the frequency of the antenna module 100 is not limited. For example, the shape, length, width and other parameters of the antenna module 100 can be adjusted to adjust the required frequency. The shape, length, width and other parameters of the radiation portion Patch can also be adjusted according to the required frequency.

In the embodiment of the present disclosure, the radiation body 200 can be any conductor, such as iron, copper foil on a PCB soft board, a conductor in a laser direct structuring (LDS) process, etc., which are not specifically limited here. For example, in one of the embodiments, the radiation body 200 is a metal frame of an electronic device. The radiation body 200 is disposed on a back plate 305 and is spaced apart from an electronic component, such as a battery 303. The antenna module 100 is arranged between the radiation body 200 and the battery 303. The battery 303 is arranged on a middle frame 307, the middle frame 307 is disposed on the back plate 305 (see details below).

In the embodiment of the present disclosure, the radiation portion Patch and the radiation body 200 are spaced apart. For example, the radiation portion Patch and the radiation body 200 are arranged in parallel. For another example, the radiation portion Patch and the radiation body 200 are spaced apart, but not parallel to each other. In other embodiments, the radiation portion Patch may also be directly connected or not connected to the radiation body 200. For example, in one of the embodiments, the radiation portion Patch is spaced apart from the radiation body 200, and is connected to the radiation body 200 through a connection wire. For another example, in another embodiment, the radiation portion Patch and the radiation body 200 are spaced apart, and there is no electrical connection between the radiation portion Patch and the radiation body 200.

In the embodiments of the present disclosure, the specific structure of the radiation body 200, and/or its connection relationship with other components are not limited. For example, the side end of the radiation body 200 may be connected to the ground (the radiation body 200 is grounded), or not connected to the ground. For another example, the radiation body 200 may be provided with breakpoints or no breakpoints, broken slots.

Figure 6:
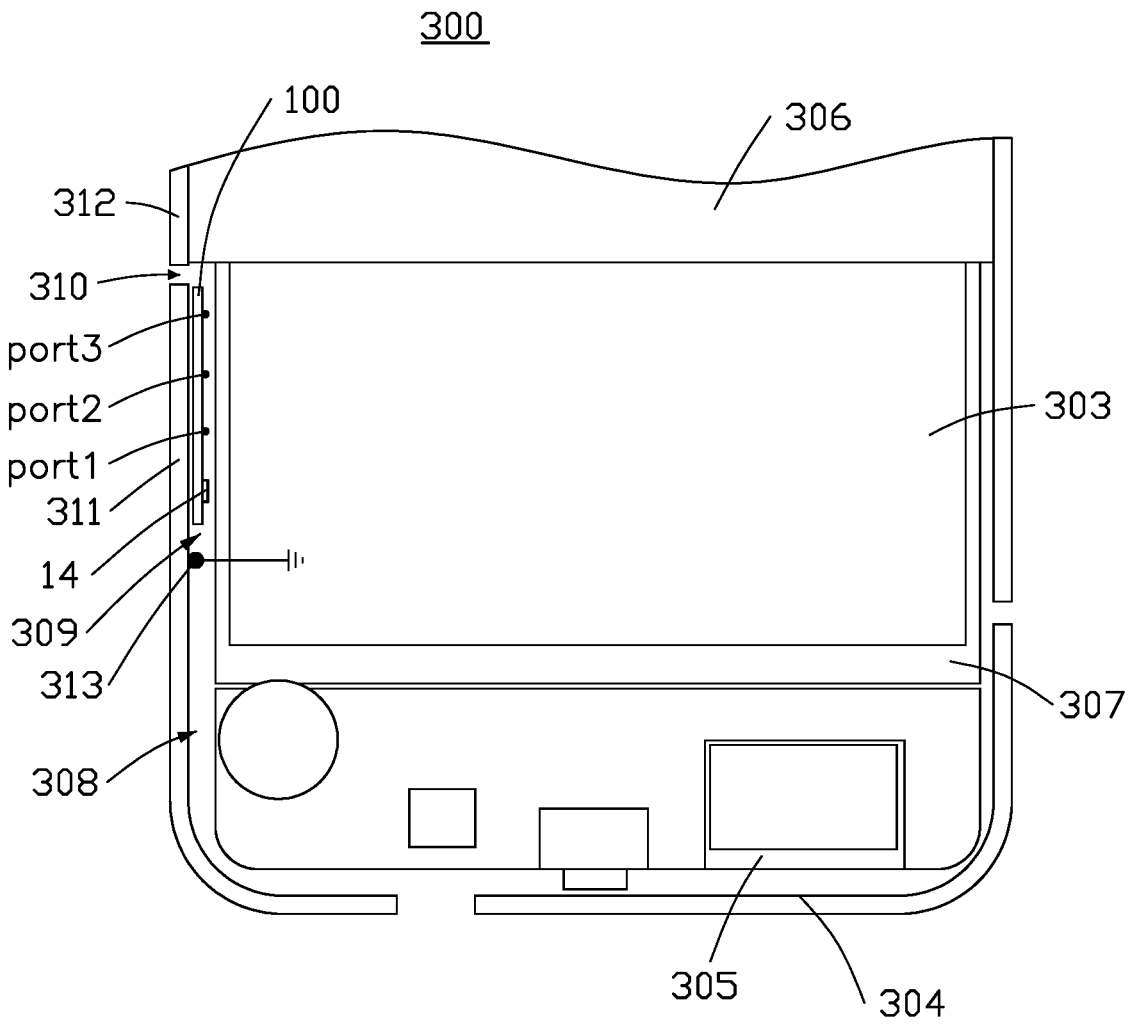
FIG. 6 is a schematic diagram of the antenna module applied to an electronic device of an embodiment of the present disclosure.

Please refer to FIG. 6, in an embodiment of the present disclosure, the antenna module 100 can be applied to an electronic device 300 to transmit and receive radio waves to transmit and exchange wireless signals. The electronic device 300 may be a handheld communication device (such as a mobile phone), a folding machine, a smart wearable device (such as a watch, earphone, etc.), a tablet computer, a personal digital assistant (personal digital assistant, PDA), which is not specifically limited here.

The electronic device 300 may adopt one or more of the following communication technologies: Bluetooth (BT) communication technology, global positioning system (GPS) communication technology, wireless fidelity (Wi-Fi) communication technology, global system for mobile communications (GSM) communication technology, wideband code division multiple access (WCDMA) communication technology, long term evolution (LTE) communication technology, 5G communication technology, SUB-6G communication technology and other future communication technologies.

In the embodiment of the present disclosure, the electronic device 300 is a mobile phone as an example for description.

Please refer to FIG. 6, in one embodiment, the electronic device 300 includes a battery 303, a frame 304, a back plate 305, a ground plane 306, and a middle frame 307 (shown in FIG. 5). The frame 304 is made of metal or other conductive materials. The back plate 305 may be made of metal or other conductive materials. The frame 304 is disposed on the edge of the back plate 305 and forms an accommodating space 308 together with the back plate 305. An opening (not shown in the figure) is provided on the side of the frame 304 opposite to the back plate 305 for accommodating a display unit (not shown).

The display unit has a display plane, and the display plane is exposed at the opening. It can be understood that the display unit can be combined with a touch sensor to form a touch screen. The touch sensor can also be called touch panel or touch sensitive panel.

In the embodiment of the present disclosure, the display unit has a high screen-to-body ratio. That is, the area of the display plane of the display unit is greater than 70% of the front area of the electronic device, and even a front full screen can be achieved. Specifically, in the embodiment of the present disclosure, the full screen means except for the necessary slots opened on the electronic device 300, the left, right, and lower sides of the display unit can be seamlessly connected to the frame 304.

The ground plane 306 may be made of metal or other conductive materials. The ground plane 306 can be disposed in the accommodating space 308 enclosed by the frame 304 and the back plate 305, and is connected to the back plate 305.

The middle frame 307 is made of metal or other conductive materials. The shape and size of the middle frame 307 can be smaller than the ground plane 306. The middle frame 307 is stacked on the ground plane 306. In this embodiment, the middle frame 307 is a metal sheet disposed between the display unit and the ground plane 306. The middle frame 307 is used to support the display unit, provide electromagnetic shielding, and improve the mechanical strength of the electronic device 300.

In the embodiment, the frame 304, the back plate 305, the ground plane 306, and the middle frame 307 may form an integrally formed metal frame. The backplane 305, the ground plane 306, and the middle frame 307 are made of large-area metal, so they can jointly form the system ground plane of the electronic device 300 (not shown in the figure).

The battery 303 is arranged on the middle frame 307 to provide electrical energy for the electronic components, modules, circuits of the electronic device 300. The battery 303 and the frame 304 are spaced apart, and a slit 309 is formed between the battery 303 and the frame 304.

In other embodiment, the electronic device 300 may also include one or more of the following components, such as a processor, a circuit board, a memory, an input and output circuit, an audio component (such as a microphone and a speaker), and a multimedia component (such as a front camera and/or a rear camera), sensor components (such as proximity sensors, distance sensors, ambient light sensors, acceleration sensors, gyroscopes, magnetic sensors, pressure sensors and/or temperature sensors), which will not be repeated here.

When the antenna module 100 is applied to the electronic device 300, the antenna module 100 can be arranged in the slit 309 and arranged substantially perpendicular to the plane where the ground plane 306 is located. A part of the frame 304 constitutes the radiation body 200, and a gap 310 is defined on the frame 304. The gap 310 partitions the frame 304 to divide the frame 304 into a first part 311 and a second part 312 which are arranged at intervals. The first part 311 constitutes the radiation body 200. The second part 312 may be electrically connected to the system ground plane, such as the ground plane 306.

The gap 310 may be connected to the slit 309 and be filled with insulating materials, such as plastic, rubber, glass, wood, ceramics, but not limited to this. In one embodiment, a ground point 313 is provided on the side of the first part 311 (the radiation body 200) away from the gap 310. One end of the ground point 313 is electrically connected to the first part 311, and the other end is electrically connected to the middle frame 307, that is, grounded. The antenna module 100 is disposed in the slit 309 between the gap 310 and the ground point 313, and is disposed substantially perpendicular to the plane where the ground plane 306 is located.

When the antenna module 100 is disposed in the slit 309, the radiation portion Patch on the antenna module 100 faces the first part 311, and spaced apart from the first part 311. The connector 14 is arranged on the other surface of the substrate 11, that is, it is arranged away from the first part 311. One end of the connector 14 is electrically connected to the middle frame 307, and the other end is electrically connected to the substrate 11.

The radiation portion Patch in the antenna module 100 is divided into three radiation branches by the slot 122, such as the first radiation branch Patch1, the second radiation branch Patch2, and the third radiation branch Patch3 as an example. Please refer to FIG. 6 and FIG. 7, each radiation branch includes a corresponding signal feed point (for example, signal feed points port1, port2, and port3, the aforementioned signal feed point 121). Each signal feed point is electrically connected to the corresponding feed source through the corresponding matching unit. For example, the signal feed point port1 of the first radiation branch Patch1 is electrically connected to the feeding source 161 through the matching unit 151. The signal feed point port2 of the second radiation branch Patch2 is electrically connected to the feeding source 162 through the matching unit 152. The signal feed point port3 of the third radiation branch Patch3 is electrically connected to the feeding source 163 through the matching unit 153.

Figure 7:
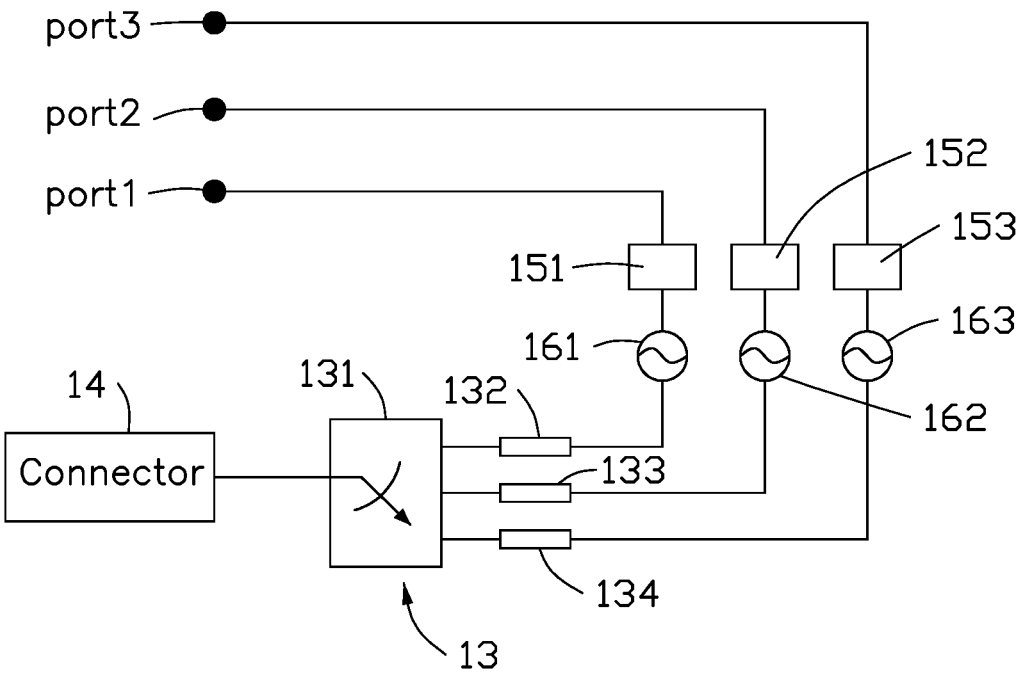
FIG. 7 is a schematic diagram of the circuit connection of the active circuit of the antenna module shown in FIG. 6.

The active circuit 13 in the antenna module 100 is disposed in the connector 14. As shown in FIG. 7, the active circuit 13 includes a switch 131 and adjustable elements 132, 133, 134. One end of the switch 131 is electrically connected to the connector 14, and the other end of the switch 131 is electrically connected to a corresponding feed source through corresponding adjustable elements 132, 133, 134. For example, the switch 131 is electrically connected to the feeding source 161 through the adjustable element 132, the switch 131 is electrically connected to the feeding source 162 through the adjustable element 133, and the switch 131 is electrically connected to the feeding source 163 through the adjustable element 134. That is, the matching circuit includes at least a matching unit 151, a matching unit 152, and a matching unit 153.

The antenna module 100 can divide the radiation portion Patch into the plurality of radiation branches, and the plurality of radiation branches are coupled to the first part 311 to resonate to form an adjustable mode. The coupling state between two adjacent radiation branches can be controlled, and independent modes with tunability and good antenna efficiency can be generated through coupling. The switching of the switch 131 in the active circuit 13 can switch multiple modes, and use multiple adjustable elements (for example, adjustable elements 132, 133, 134) to achieve multiple frequency bands.

Figure 8:
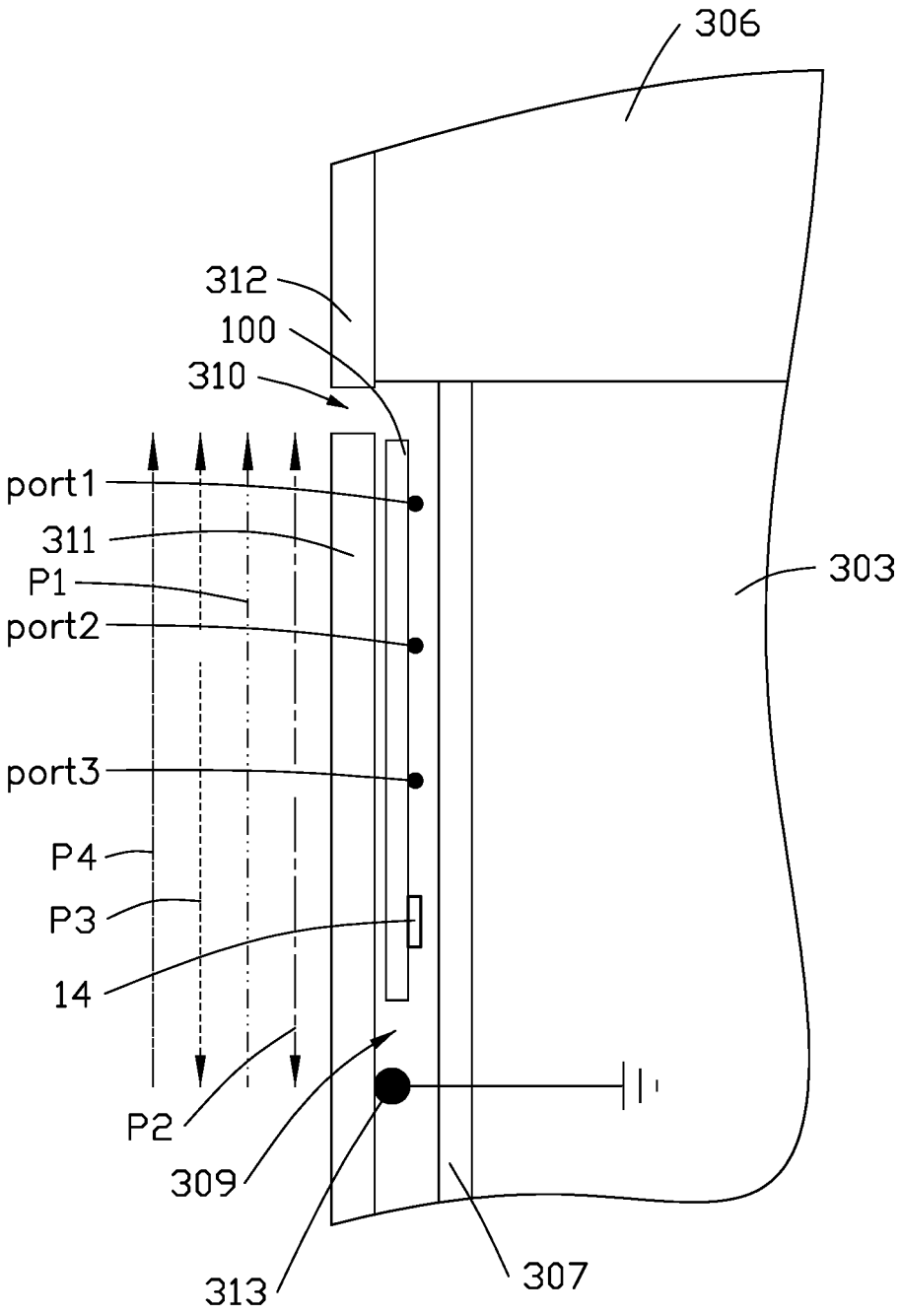
FIG. 8 is a schematic diagram of the current path of the antenna module shown in FIG. 6.

FIG. 8 is a schematic diagram of the current path of the electronic device 300. The first radiation branch Patch1 with signal feed point port1 can excite Wi-Fi 2.4G (such as path P1), Wi-Fi 5G (such as path P2) and License Assisted Access (LAA) modes. The Wi-Fi 2.4Q Wi-Fi 5G and LAA frequency bands can be coupled and resonated by using the slit 309, which has the best antenna efficiency, and the working frequency range of the first radiation branch Patch1 can cover the Wi-Fi 2.4G frequency band (2400 MHz-2484 MHz), Wi-Fi 5G frequency band (5150 MHz-5850 MHz) and LAA frequency band (5150 MHz-5925 MHz).

The second radiation branch Patch2 with signal feed point port2 can excite UHB mode and 5G Sub6 NR mode (such as path P3). UHB band and 5G Sub6 NR band can be coupled and resonated by using slit 309, which has the best antenna efficiency. The operating frequency range of the second radiation branch Patch2 can cover the UHF frequency band (3400 MHz-3800 MHz) and 5G Sub6 NR frequency band (for example, 5G Sub6 N77 frequency band (3300 MHz-4radiation body 200 MHz), 5G Sub6 N78 frequency band (3300 MHz-3800 MHz) And 5G Sub6 N79 frequency band ((4400 MHz-5000 MHz) frequency band).

The third radiation branch Patch3 with the signal feed point port3 can excite the medium and high frequency modes (such as path P4), mid- and high-frequency bands can be coupled and resonated by using slit 309, which has the best antenna efficiency. The working frequency range of the third radiation branch Patch3 can cover the intermediate frequency of GSM1800/1900/WCDMA2100 frequency band (1710 MHz-2170 MHz), and the high frequency LTE B7, B40, B41 frequency band (2300 MHz-2690 MHz).

The switch 131 is a mid-high frequency/UHB and NR/Wi-Fi 2.4Q Wi-Fi 5G and LAA switch, used to switch mid-high frequency/UHB and NR/Wi-Fi 2.4Q Wi-Fi 5G and LAA Frequency band.

The antenna module 100 can be applied to the electronic device 300, to increase the antenna efficiency bandwidth and have the best antenna efficiency, and the switching of the switch 131 can effectively improve the antenna frequency coverage. In one embodiment, the applicable working frequency range of the antenna module 100 can cover the intermediate frequency of 1710 MHz to 2170 MHz, the high frequency of 2300 MHz-2690 MHz, UHF 3400 MHz to 3800 MHz, Wi-Fi 2.4Q Wi-Fi 5G and LAA, and can support 5G Sub6 N77/N78/N79 frequency bands.

The antenna module 100 can set the radiation portion Patch as an independent sheet body, or use the slot 122 to divide the radiation portion Patch into the plurality of radiation branches, and set corresponding signal feed points at appropriate positions of the radiation portion Patch or the plurality of radiation branches, and the radiation body 200 (or the metal frame of the electronic device 300, for example, the first part 311) is used as a metal radiator, the radiation body 200 and the antenna module 100 couple the energy to resonate the mode in the slit 309, to cover medium, high frequency, UHF, 5G Sub6 N77, 5G Sub6 N78, 5G Sub6 N79, Wi-Fi 2.4Q Wi-Fi 5G frequency bands, so as to greatly increase its bandwidth and antenna efficiency, and can also cover the world's commonly used 5G The application of communication frequency bands and the requirements of Carrier Aggregation (CA) supporting LTE-A (short for LTE-Advanced, which is the subsequent evolution of LTE technology).

Figure 9A:
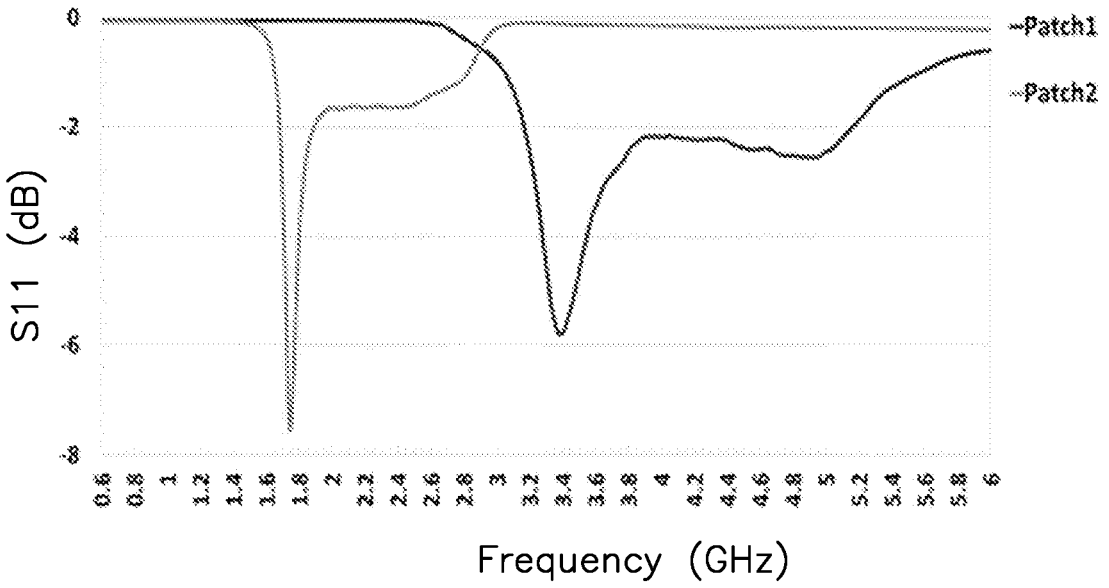
FIGS. 9A to 9J are graphs of S parameters (scattering parameters) when two or three radiation branches are disposed in the radiation portion of the antenna module according to the embodiment of the present disclosure.
Figure 9B:
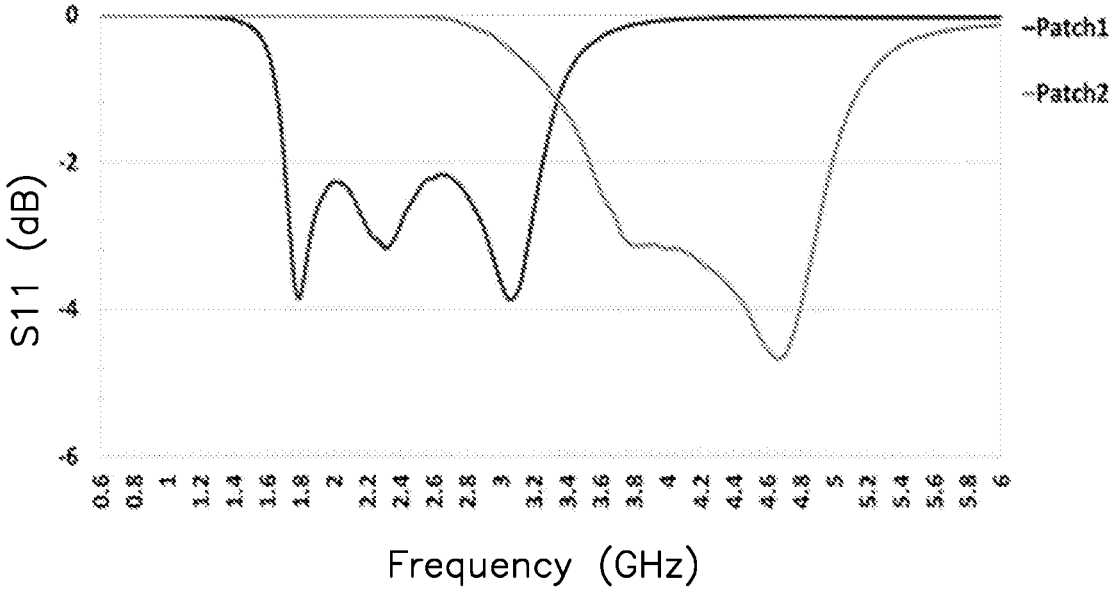
Figure 9C:
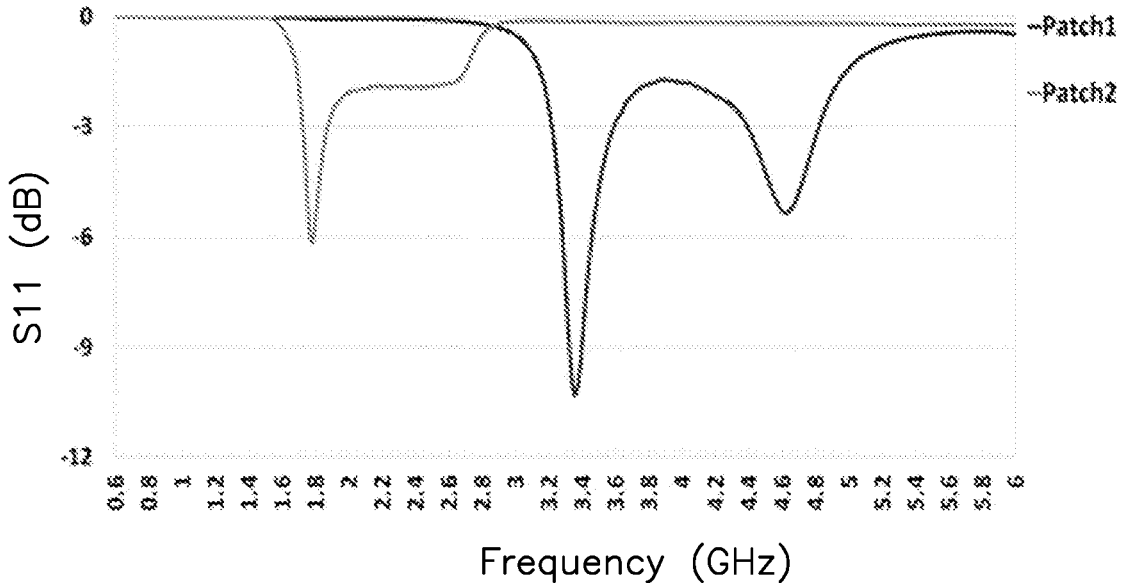
Figure 9D:
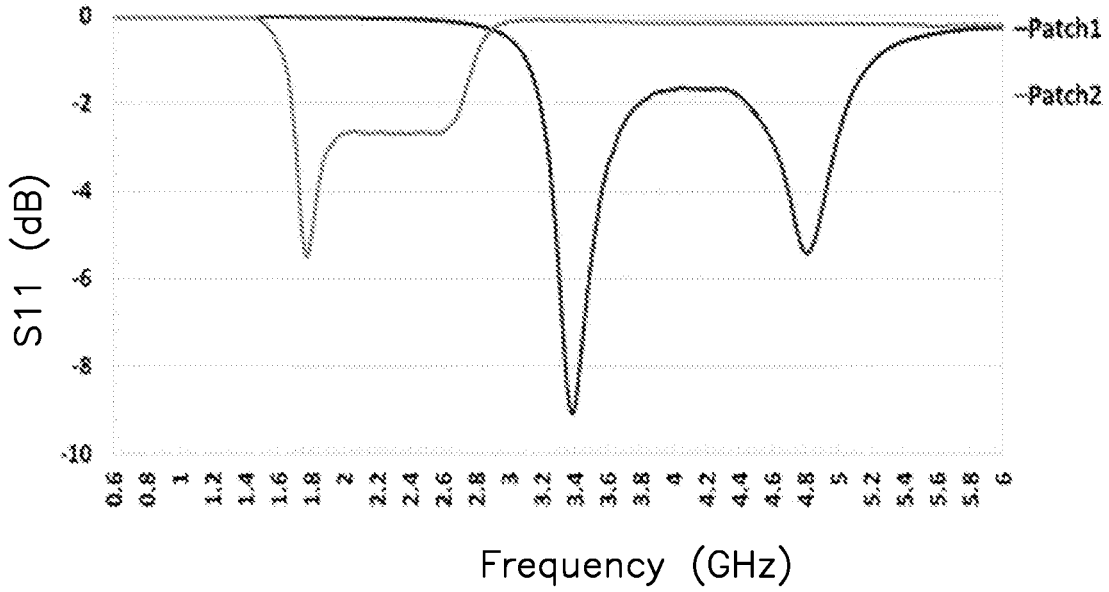
Figure 9E:
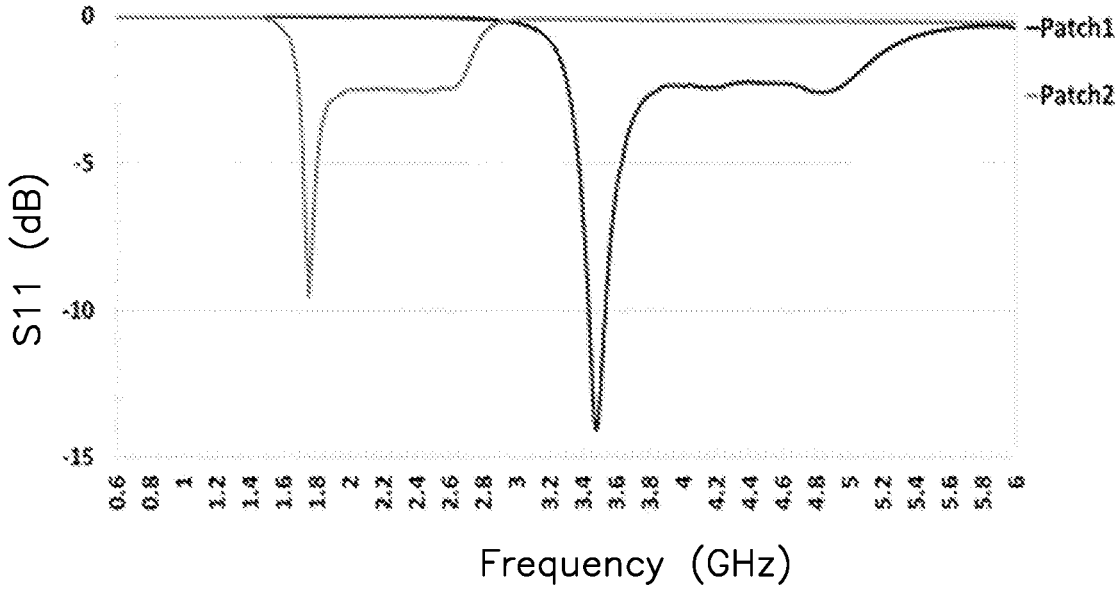
Figure 9F:
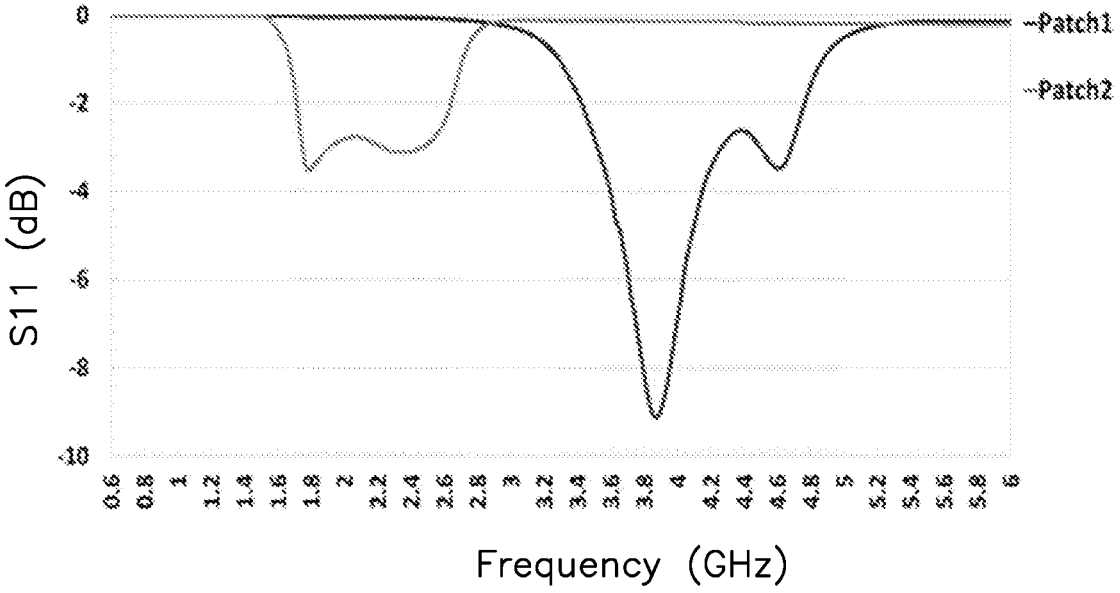
Figure 9G:
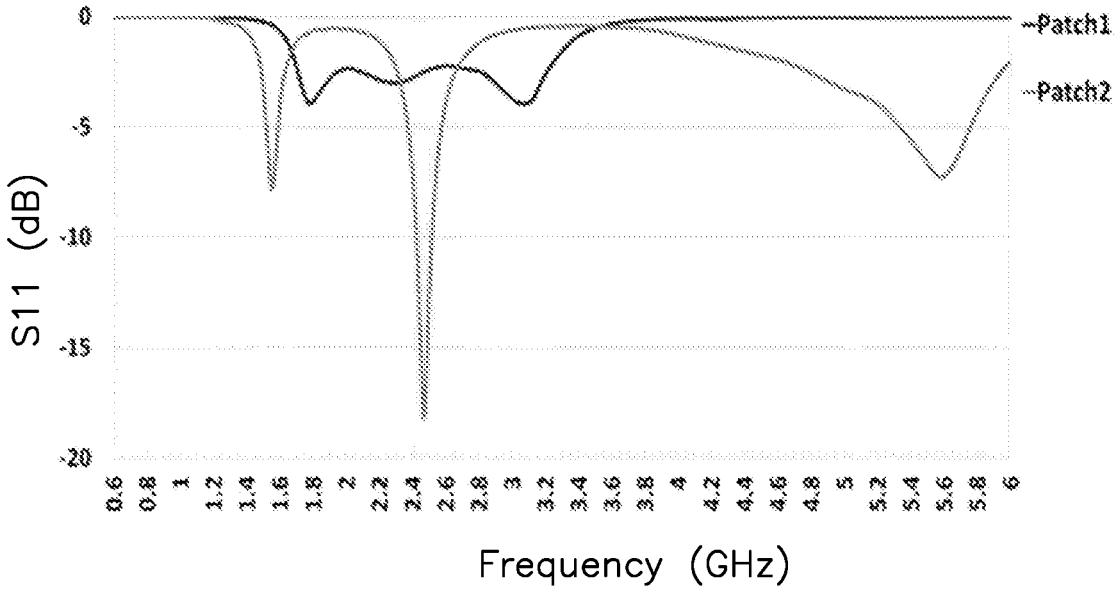
Figure 9H:
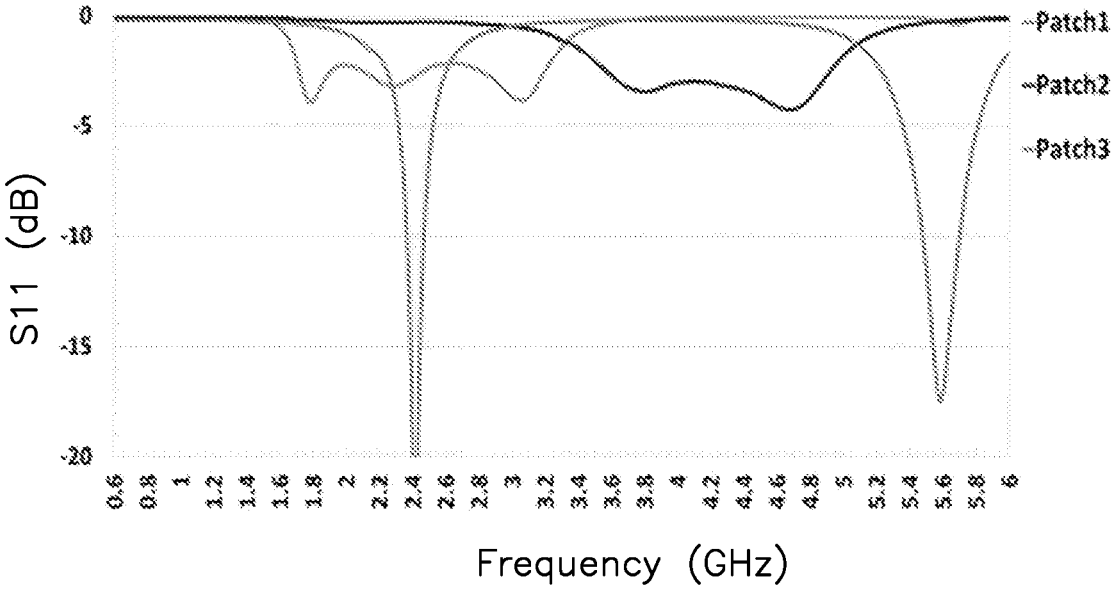
Figure 9I:
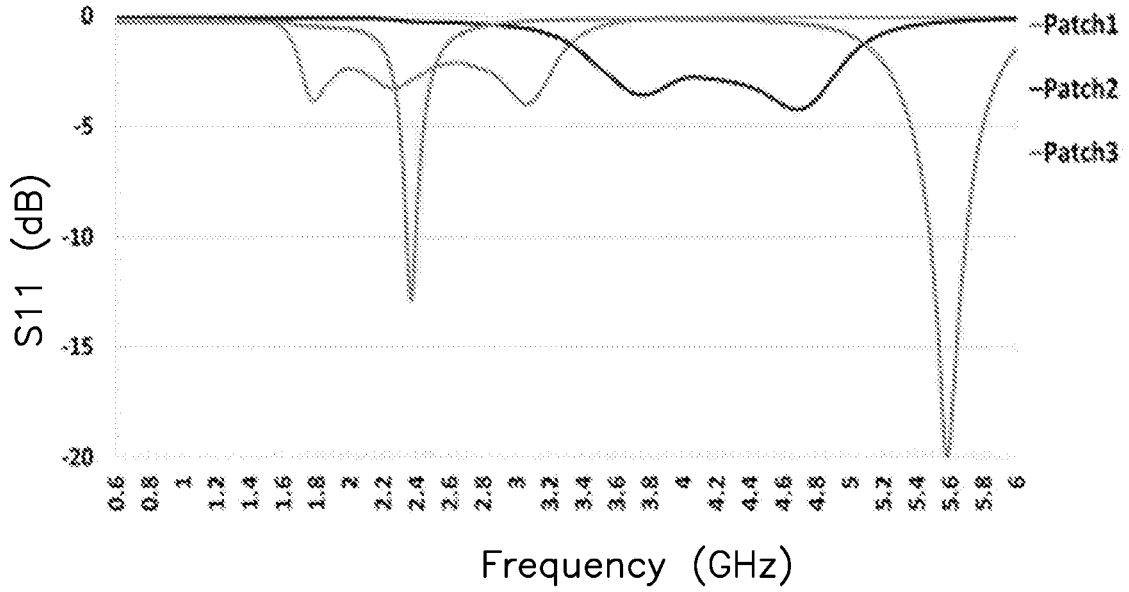
Figure 9J:
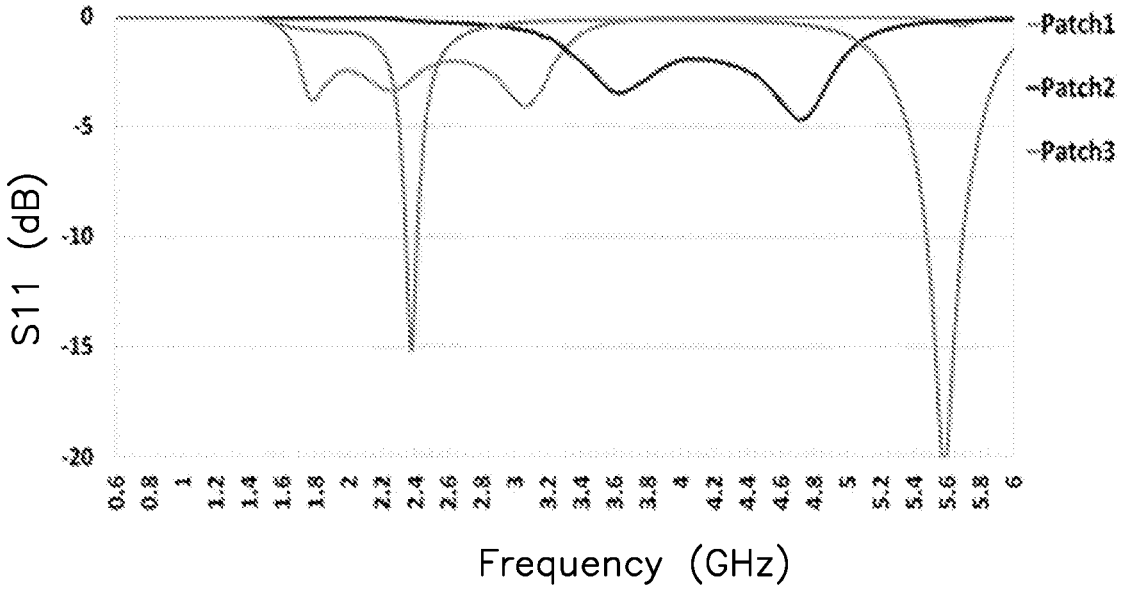

FIGS. 9A to 9J are graphs of S parameters (scattering parameters) when the antenna module 100 uses the slot 122 to divide the radiation portion Patch into two or three radiation branches. As shown in FIG. 9A, FIG. 9C, FIG. 9D, FIG. 9E and FIG. 9F, the first radiation branch Patch1 covers UHF 3400-3800 MHz, and can support 5G Sub N77/N78/N79 frequency bands. The second radiation branch Patch2 covers intermediate frequency 1710-2170 MHz and high frequency 2300-2690 MHz. As shown in FIG. 9B, the first radiation branch Patch1 covers the intermediate frequency of 1710-2170 MHz and the high frequency of 2300-2690 MHz, the second radiation branch Patch2 covers UHF 3400-3800 MHz, and can support 5G Sub N77/N78/N79 frequency bands. As shown in FIG. 9Q the first radiation branch Patch1 covers the intermediate frequency of 1710-2170 MHz and the high frequency of 2300-2690 MHz, the second radiation branch Patch2 covers GPS, Wi-Fi 2.4Q Wi-Fi 5G and LAA frequency bands. As shown in FIG. 9H, FIG. 9I and FIG. 9J, the first radiation branch Patch1 covers the intermediate frequency of 1710-2170 MHz and the high frequency of 2300-2690 MHz, the second radiation branch Patch2 covers UHF 3400-3800 MHz, and can support 5G Sub N77/N78/N79 frequency bands. The third radiation branch Patch3 covers Wi-Fi 2.4G, Wi-Fi 5G and LAA frequency bands.

The switch 131 switches to different signal feed points, the frequency mode can be controlled to cover the intermediate frequency of 1710-2170 MHz, the high frequency of 2300-2690 MHz, UHF 3400-3800 MHz, GPS, Wi-Fi 2.4Q Wi-Fi 5G and LAA frequency bands, and can support 5G Sub N77/N78/N79 frequency bands.

Figure 10A:
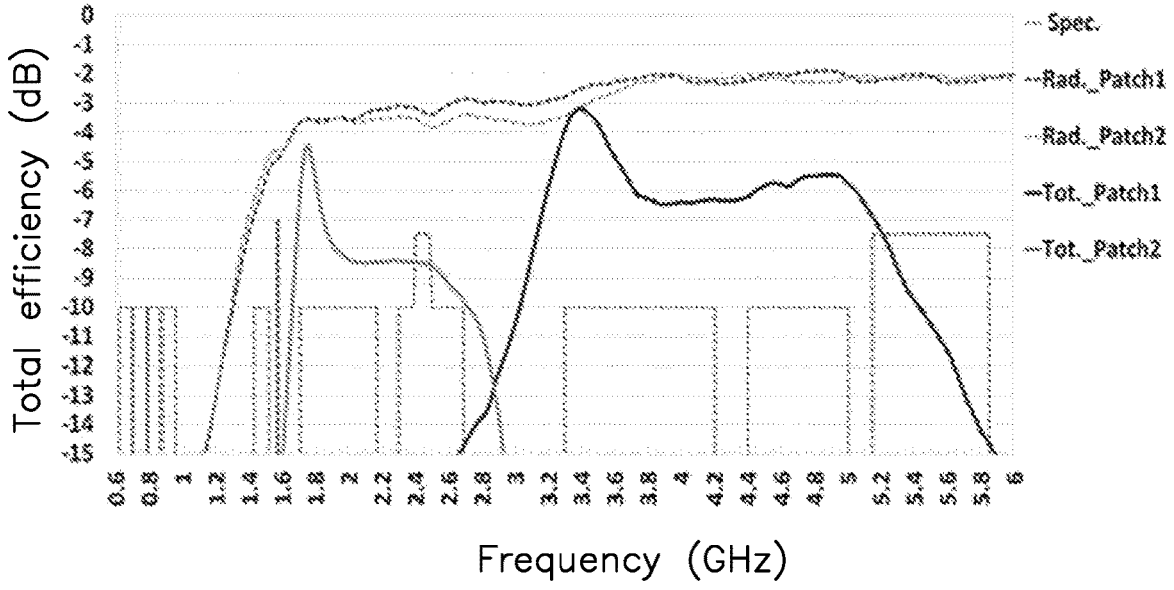
FIGS. 10A to 10J are efficiency graphs when two or three radiation branches are disposed in the radiation portion of the antenna module according to the embodiment of the present disclosure.
Figure 10B:
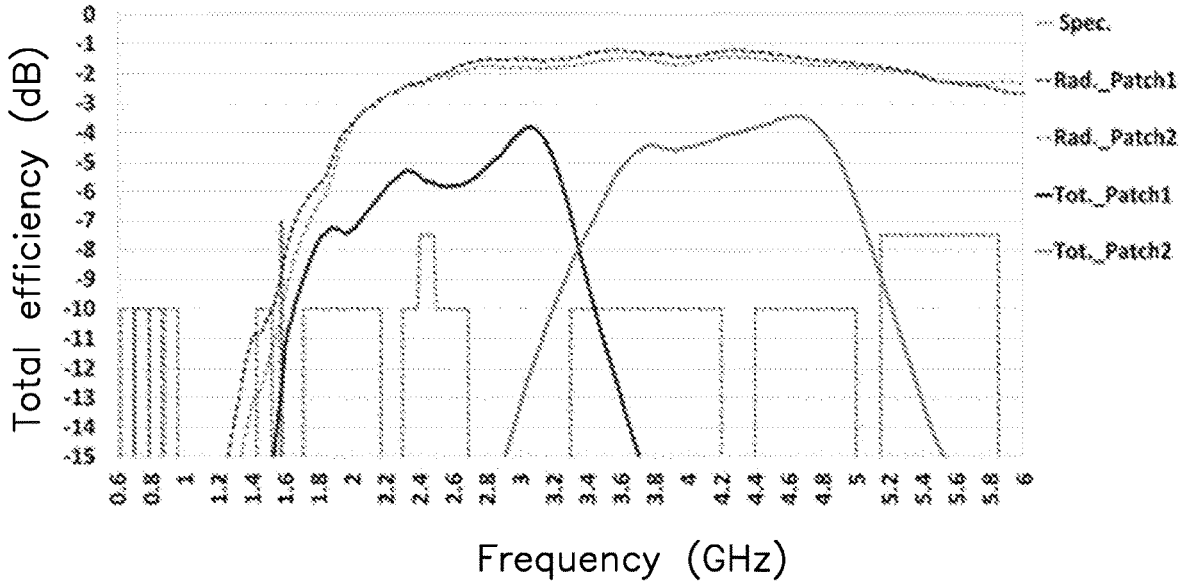
Figure 10C:
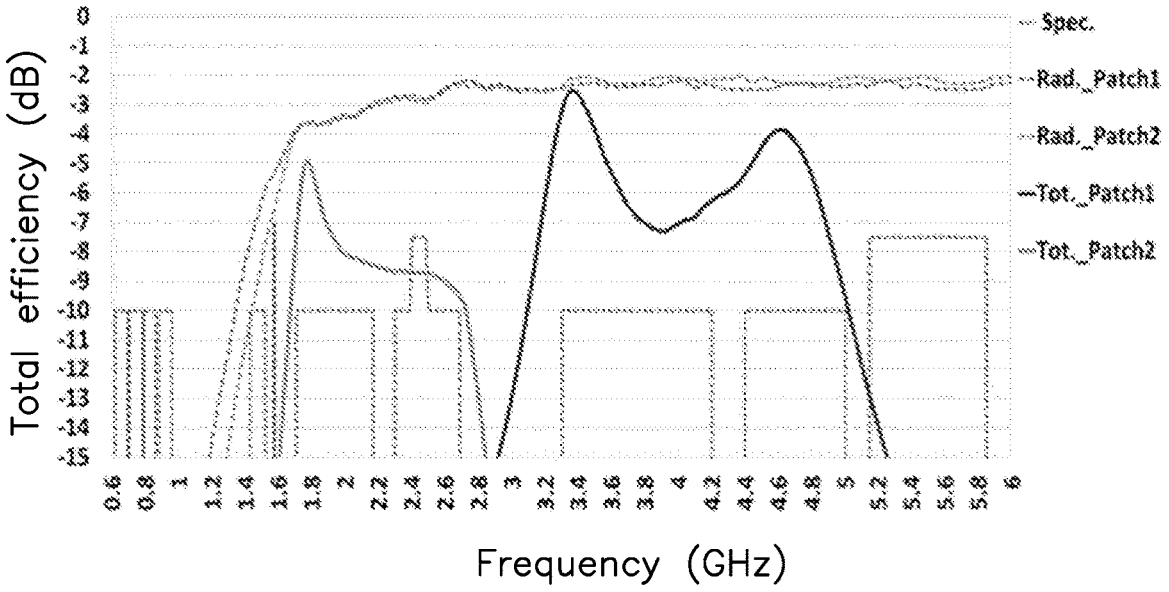
Figure 10D:
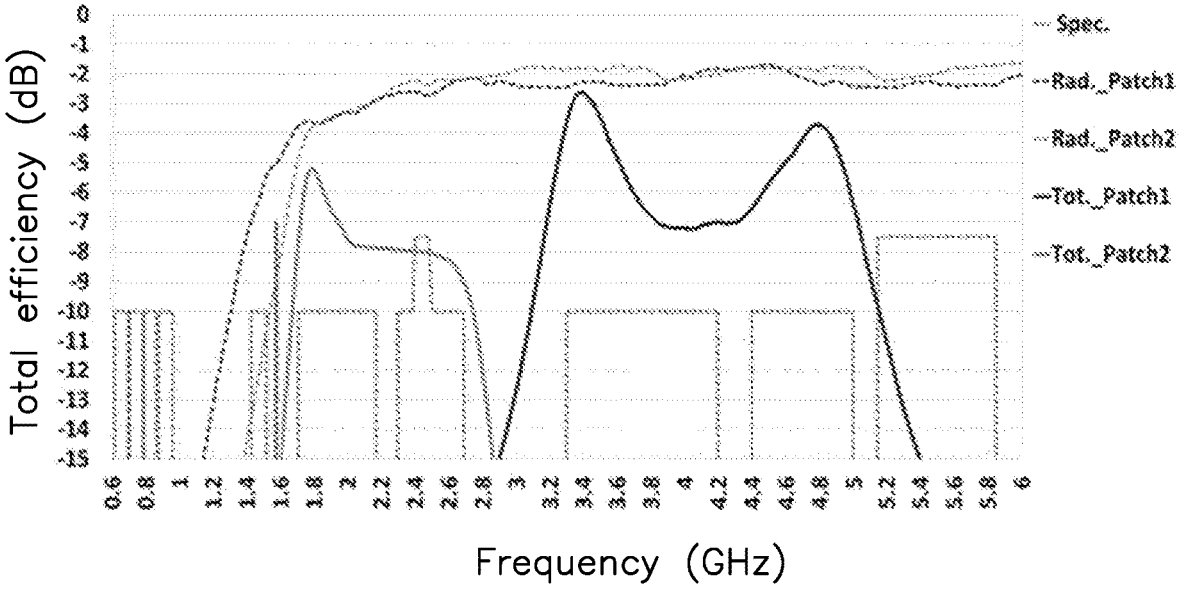
Figure 10E:
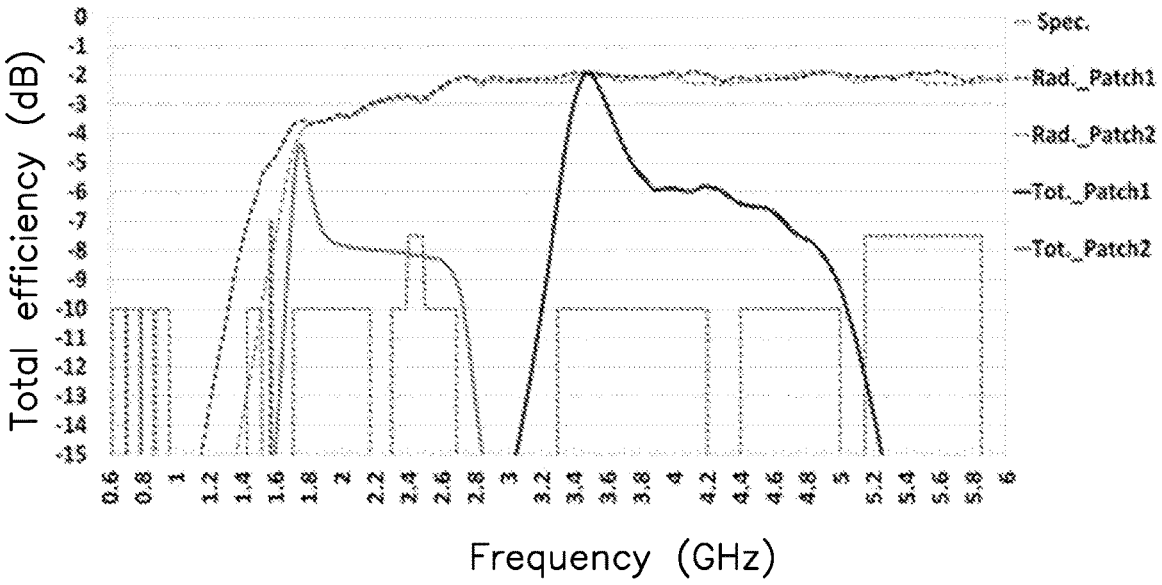
Figure 10F:
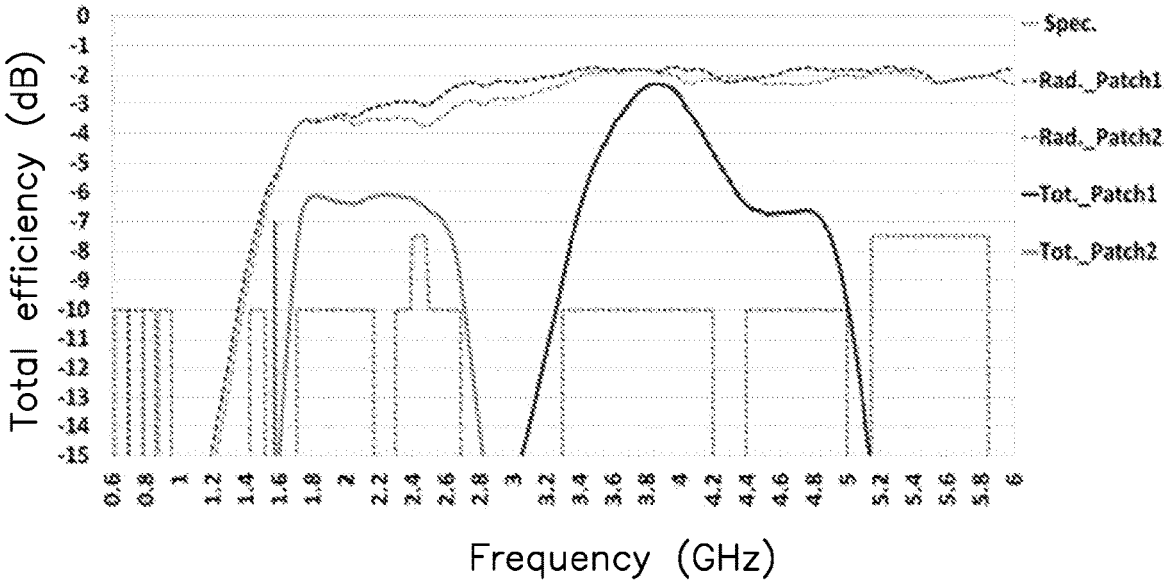
Figure 10G:
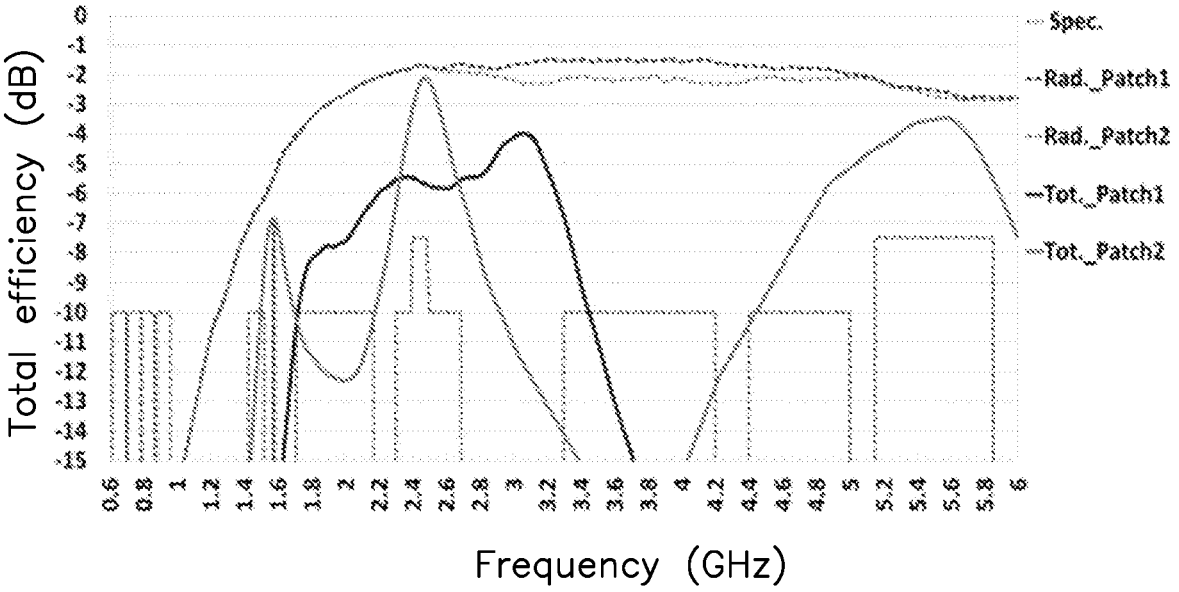
Figure 10H:
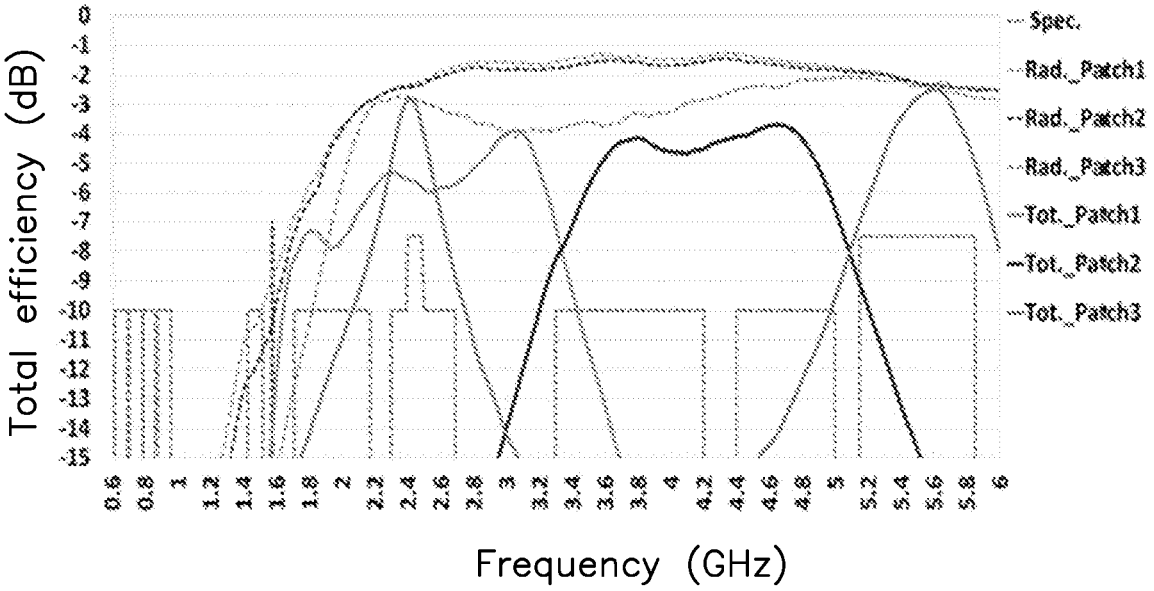
Figure 10I:
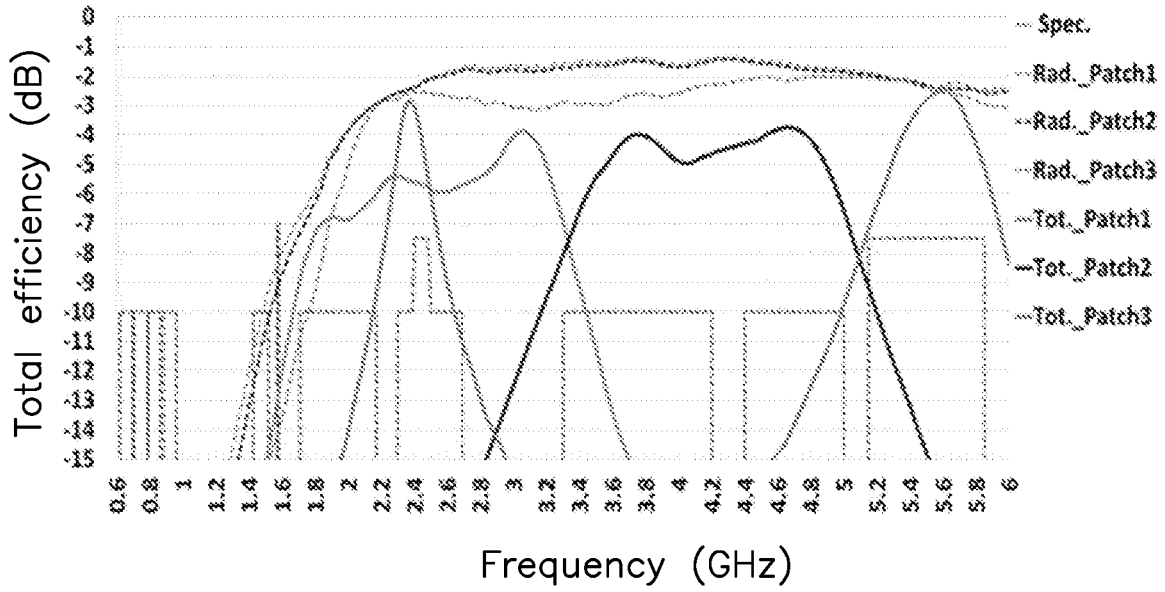
Figure 10J:
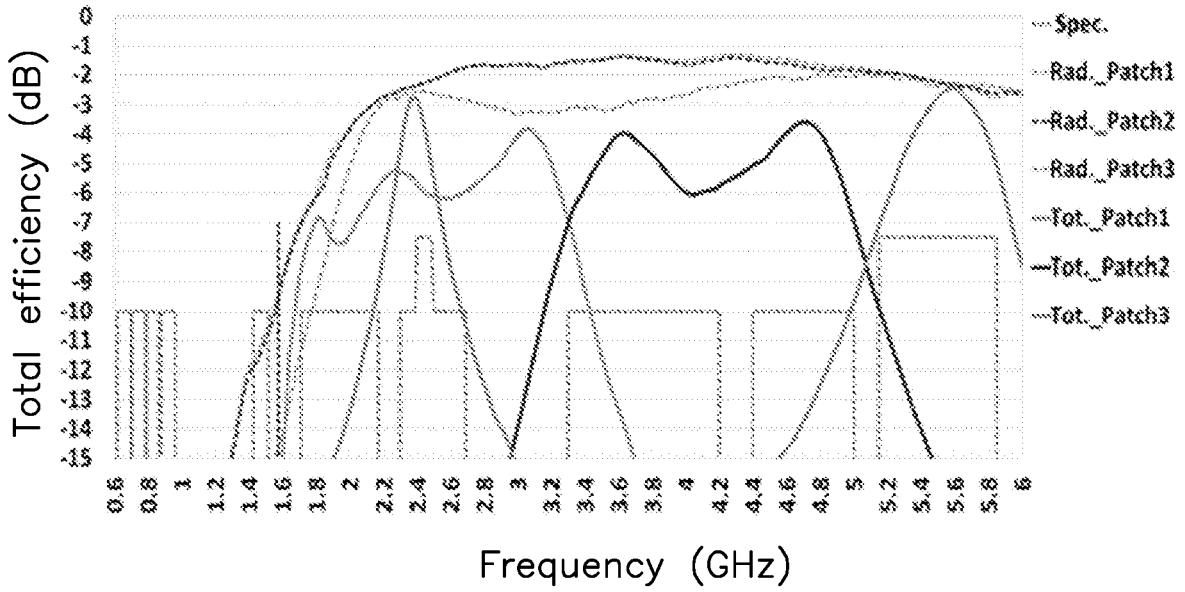

FIGS. 10A to 10J are efficiency graphs when the antenna module 100 uses the slot 122 to divide the radiation portion Patch into two or three radiation branches. FIG. 10A shows the radiation efficiency (Rad. shown in the figure) and total efficiency (Tot. shown in the figure) values of each radiation branch when the radiation portion Patch in the antenna module 100 is divided into two radiation branches as shown in FIG. 3B (namely, the first radiation branch Patch1 and the second radiation branch Patch2). As shown in FIG. 10A, FIG. 10C, FIG. 10D, FIG. 10E and FIG. 10F, the first radiation branch Patch1 covers UHF 3400-3800 MHz, and can support 5G Sub N77/N78/N79 frequency bands. The second radiation branch Patch2 covers the intermediate frequency of 1710-2170 MHz and the high frequency of 2300-2690 MHz. As shown in FIG. 10B, the first radiation branch Patch1 covers the intermediate frequency of 1710-2170 MHz and the high frequency of 2300-2690 MHz, the second radiation branch Patch2 covers UHF 3400-3800 MHz, and can support 5G Sub N77/N78/N79 frequency bands. As shown in FIG. 10G the first radiation branch Patch1 covers the intermediate frequency of 1710-2170 MHz and the high frequency of 2300-2690 MHz, the second radiation branch Patch2 covers GPS, Wi-Fi 2.4G; Wi-Fi 5G and LAA frequency bands. As shown in FIG. 10H, FIG. 10I and FIG. 10J, the first radiation branch Patch1 covers the intermediate frequency of 1710-2170 MHz and the high frequency of 2300-2690 MHz, the second radiation branch Patch2 covers UHF 3400-3800 MHz, and can support 5G Sub N77/N78/N79 frequency bands. The third radiation branch Patch3 covers Wi-Fi 2.4G Wi-Fi 5G and LAA frequency bands.

The antenna module 100 sets the switch 131 and makes the switch 131 switch to different signal feed points, to control the frequency mode, and cover the intermediate frequency (1710 MHz-2170 MHz), the high frequency (2300 MHz-2690 MHz), UHF (3400 MHz-3800 MHz), Wi-Fi 2.4G Wi-Fi 5G and LAA, and can support 5G Sub6 N77/N78/N79 frequency bands.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. An antenna module comprising:

a substrate;

a radiation portion disposed on the substrate; wherein the radiation portion is a complete sheet body made of conductive material, at least one signal feed point is disposed on one side of the radiation portion to feed electrical signals to the radiation portion respectively; wherein the radiation portion defines at least one slot, and the slot divides the radiation portion into radiation branches disposed at intervals, and each radiation branch is electrically connected to a corresponding signal feed point to feed electrical signals to each radiation branch; and an active circuit disposed on the substrate; wherein the active circuit is electrically connected to the radiation portion to switch radiation modes of the radiation portion.

2. The antenna module according to claim 1, wherein area allocation of the radiation branches is adjusted in proportion to a bandwidth requirement, to provide a wide band coupling effect through a large area.

3. The antenna module according to claim 1, wherein the substrate comprises a first surface and a second surface, the first surface is disposed facing the radiation portion, the second surface is disposed opposite to the first surface, the radiation portion is disposed on the first surface, and the active circuit and a connector are disposed on the second surface.

4. The antenna module according to claim 1, wherein two ends of the slot are arranged on two adjacent sides or two opposite sides of the radiation portion, and the radiation branches of different shapes are cut out by changing a shape and a arrangement position of the slot.

5. The antenna module according to claim 1, wherein the active circuit comprises a switch and a plurality of adjustable elements, a frequency radiation mode of the antenna module is controlled by switching the switch to a corresponding adjustable element and a corresponding feed source, to cover an intermediate frequency band, a high frequency band, a ultra-high frequency band (UHB), a global positioning system (GPS) radiation mode, a Wi-Fi 2.4G frequency band, a Wi-Fi 5G frequency band, a licensed spectrum assisted access (LAA) frequency band, and a 5G Sub6 NR frequency band.

6. The antenna module according to claim 1, wherein the antenna module further comprises a radiation body, the radiation body and the radiation portion are spaced apart, the radiation body and the radiation portion are coupled to each other to generate a plurality of radiation modes, and transmit and/or receive signals through the radiation body.

7. An electronic device comprising:

an antenna module comprising:

a substrate;

a radiation portion disposed on the substrate; wherein the radiation portion is a complete sheet body made of conductive material, at least one signal feed point is disposed on one side of the radiation portion to and feed electrical signals to the radiation portion respectively; wherein the radiation portion defines at least one slot, and the slot divides the radiation portion into radiation branches disposed at intervals, and each radiation branch is electrically connected to a corresponding signal feed point, to feed electrical signals to each radiation branch;

an active circuit disposed on the substrate; wherein the active circuit is electrically connected to the radiation portion to switch radiation modes of the radiation portion.

8. The electronic device according to claim 7, wherein area allocation of the radiation branches is adjusted in proportion to a bandwidth requirement, to provide a wide band coupling effect through a large area.

9. The electronic device according to claim 7, wherein the substrate comprises a first surface and a second surface, the first surface is disposed facing the radiation portion, the second surface is disposed opposite to the first surface, the radiation portion is disposed on the first surface, and the active circuit and a connector are disposed on the second surface.

10. The electronic device according to claim 7, wherein two ends of the slot are arranged on two adjacent sides or two opposite sides of the radiation portion, and the radiation branches of different shapes are cut out by changing a shape and a arrangement position of the slot.

11. The electronic device according to claim 7, wherein the active circuit comprises a switch and a plurality of adjustable elements, a frequency radiation mode of the antenna module is controlled by switching the switch to a corresponding adjustable element and a corresponding feed source, to cover an intermediate frequency band, a high frequency band, a ultra-high frequency band (UHB), a global positioning system (GPS) radiation mode, a Wi-Fi 2.4G frequency band, a Wi-Fi 5G frequency band, a licensed spectrum assisted access (LAA) frequency band, and a 5G Sub6 NR frequency band.

12. The electronic device according to claim 7, wherein the antenna module further comprises a radiation body, the radiation body and the radiation portion are spaced apart, the radiation body and the radiation portion are coupled to each other to generate a plurality of radiation modes, and transmit and/or receive signals through the radiation body.

13. The electronic device according to claim 7, wherein the electronic device further comprises a metal frame, part of the metal frame constitutes a radiation body, the radiation body and the radiation portion are spaced apart, and the radiation body and the radiation portion are coupled to each other to generate plurality of radiation modes, and transmit and/or receive signals through the radiation body.

14. The electronic device according to claim 13, wherein the metal frame defines a gap, the gap separates the metal frame to divide the metal frame into a first part and a second part arranged at intervals, the first part constitutes the radiation body, and the second part is grounded.

15. The electronic device according to claim 14, wherein a ground point is disposed on one side of the first part away from the second part, a first terminal of the ground point is electrically connected to the first part, and a second terminal of the ground point is grounded.

16. The electronic device according to claim 15, wherein the electronic device further comprises a battery, the battery and the metal frame are spaced apart, and a slit is formed between the battery and the metal frame, and the antenna module is disposed in the slit between the gap and the ground point, and the radiation portion and the first part are spaced apart.

* * * * *